US008988295B2

(12) United States Patent
Swais et al.

(10) Patent No.: US 8,988,295 B2
(45) Date of Patent: Mar. 24, 2015

(54) MULTIBAND ANTENNA ASSEMBLIES WITH MATCHING NETWORKS

(71) Applicant: Laird Technologies, Inc., Earth City, MO (US)

(72) Inventors: Imad M Swais, Bloomingdale, IL (US); Robert K Antonio, Lake Zurich, IL (US); Tam Hung Chau, Berkeley, IL (US)

(73) Assignee: Laird Technologies, Inc., Earth City, MO (US)

( * ) Notice: Subject to any disclaimer, the term of this patent is extended or adjusted under 35 U.S.C. 154(b) by 342 days.

(21) Appl. No.: 13/657,538

(22) Filed: Oct. 22, 2012

(65) Prior Publication Data

US 2013/0069835 A1 Mar. 21, 2013

Related U.S. Application Data

(63) Continuation-in-part of application No. 13/236,382, filed on Sep. 19, 2011, now Pat. No. 8,823,600.

(60) Provisional application No. 61/701,814, filed on Sep. 17, 2012.

(51) Int. Cl.

| | |
|---|---|
| ***H01Q 1/50*** | (2006.01) |
| ***H01Q 1/32*** | (2006.01) |
| ***H01Q 9/34*** | (2006.01) |

(52) U.S. Cl.

CPC ..... *H01Q 1/3275* (2013.01); *H01Q 9/34* (2013.01); *H01Q 5/321* (2013.01)

USPC ..... 343/715; 343/713

(58) Field of Classification Search

CPC ..... H01Q 1/3275; H01Q 9/34

USPC ..... 343/711, 713, 715, 878

See application file for complete search history.

(56) References Cited

U.S. PATENT DOCUMENTS

| | | | | |
|---|---|---|---|---|
| 4,115,779 | A | 9/1978 | Dantzler et al. | |
| 5,030,963 | A * | 7/1991 | Tadama | 343/702 |
| 5,612,652 | A * | 3/1997 | Crosby | 333/24 R |
| 5,977,931 | A | 11/1999 | Openlander | |
| 6,204,817 | B1 * | 3/2001 | Edvardsson | 343/702 |
| 6,292,156 | B1 | 9/2001 | Openlander | |
| 6,930,643 | B2 | 8/2005 | Byrne et al. | |
| 7,002,530 | B1 * | 2/2006 | Chung et al. | 343/895 |
| 7,053,843 | B2 * | 5/2006 | Nysen | 343/702 |
| 7,268,734 | B2 | 9/2007 | Cislo | |
| 7,339,548 | B2 | 3/2008 | Cislo | |

(Continued)

OTHER PUBLICATIONS

MBO16394 NMO Mount, High Frequency, High Performance Permanent ¾" NMO Mount; Copyright 2009; 2 pages.

Multi-band Mobile Antenna WPD136M6C-001; Copyright 2009; 2 pages.

(Continued)

*Primary Examiner* — Tho G Phan

(74) *Attorney, Agent, or Firm* — Harness, Dickey & Pierce, P.L.C.

(57) ABSTRACT

An exemplary embodiment of a base assembly includes a printed circuit board and a balun coupled to the printed circuit. The printed circuit board and balun are configured to be operable for providing impedance matching via a matching network that includes a first inductor, a second inductor, and a concentric capacitance. The base assembly is operable for providing a multiband antenna assembly with impedance matching simultaneously with more than one frequency band.

20 Claims, 23 Drawing Sheets

(56) References Cited

U.S. PATENT DOCUMENTS

| | | | | |
|---|---|---|---|---|
| 7,439,932 | B2 | 10/2008 | Lin | |
| 8,838,042 | B2 * | 9/2014 | Lu et al. | 455/73 |
| 2002/0002037 | A1 * | 1/2002 | Ito et al. | 455/101 |

OTHER PUBLICATIONS

Nonfinal Office Action dated Dec. 26, 2013 for U.S. Appl. No. 13/236,382 which is the parent application to the instant application; 20 pages.

* cited by examiner

AZIMUTH PLANE @ 156 MHz

AZIMUTH PLANE @ 450 MHz

AZIMUTH PLANE @ 810 MHz

Phi 0° PLANE @ 450 MHz

Phi 0° PLANE @ 810 MHz

MULTIBAND ANTENNA ASSEMBLIES WITH MATCHING NETWORKS

CROSS-REFERENCE TO RELATED APPLICATION

This application is a continuation-in-part of U.S. patent application Ser. No. 13/236,382 filed Sep. 19, 2011. This application is also a nonprovisional of U.S. Provisional Patent Application No. 61/701,814 filed Sep. 17, 2012. The entire disclosures of the above applications are incorporated herein by reference.

FIELD

The present disclosure generally relates to matching networks and multiband antenna assemblies including the same that are operable with high gain and broad bandwidth coverage.

BACKGROUND

This section provides background information related to the present disclosure which is not necessarily prior art.

Multiband antennas typically include multiple antennas to cover and operate multiple frequency ranges. A printed circuit board (PCB) having a radiating antenna element thereon is a typical component of a multiband antenna assembly. Another typical component of a multiband antenna assembly is an external antenna, such as an aerial whip antenna rod. The multiband antenna assembly may be mounted to an antenna mount, which, in turn, is installed or mounted on a vehicle surface, such as the roof, trunk, or hood of the vehicle. The antenna mount may be interconnected (e.g., via a coaxial cable, etc.) to one or more electronic devices (e.g., a radio device, etc.), such that the multiband antenna is then operable for transmitting and/or receiving radio frequency signals to/from the radio device via the antenna mount.

SUMMARY

This section provides a general summary of the disclosure, and is not a comprehensive disclosure of its full scope or all of its features.

According to various aspects, exemplary embodiments are disclosed of base assemblies that include matching networks and multiband antenna assemblies including the same. For example, an exemplary embodiment of a base assembly includes a printed circuit board and a balun coupled to the printed circuit. The printed circuit board and balun are configured to be operable for providing impedance matching via a matching network that includes a first inductor, a second inductor, and a concentric capacitance. The base assembly is operable for providing a multiband antenna assembly with impedance matching simultaneously with more than one frequency band.

Another exemplary embodiment includes a multiband antenna assembly operable in at least a very high frequency (VHF) band from 136 Megahertz (MHz) to 174 MHz, an ultra high frequency (UHF) band from 380 MHz to 520 MHz, and a 700/800 MHz frequency band from 760 MHz to 870 MHz. The multiband antenna assembly includes a base assembly operable for providing impedance matching simultaneously with the VHF band, the UHF band, and the 700/800 MHz frequency band. An aerial whip antenna assembly is mounted to the base assembly. The base assembly includes a printed circuit board and a balun coupled to the printed circuit. The base assembly also includes a base ring portion configured for mounting the base assembly to an antenna mount. A contact pin is configured for providing an electrical connection between a contact of the antenna mount and the printed circuit board when the base assembly is mounted to the antenna mount.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 19:
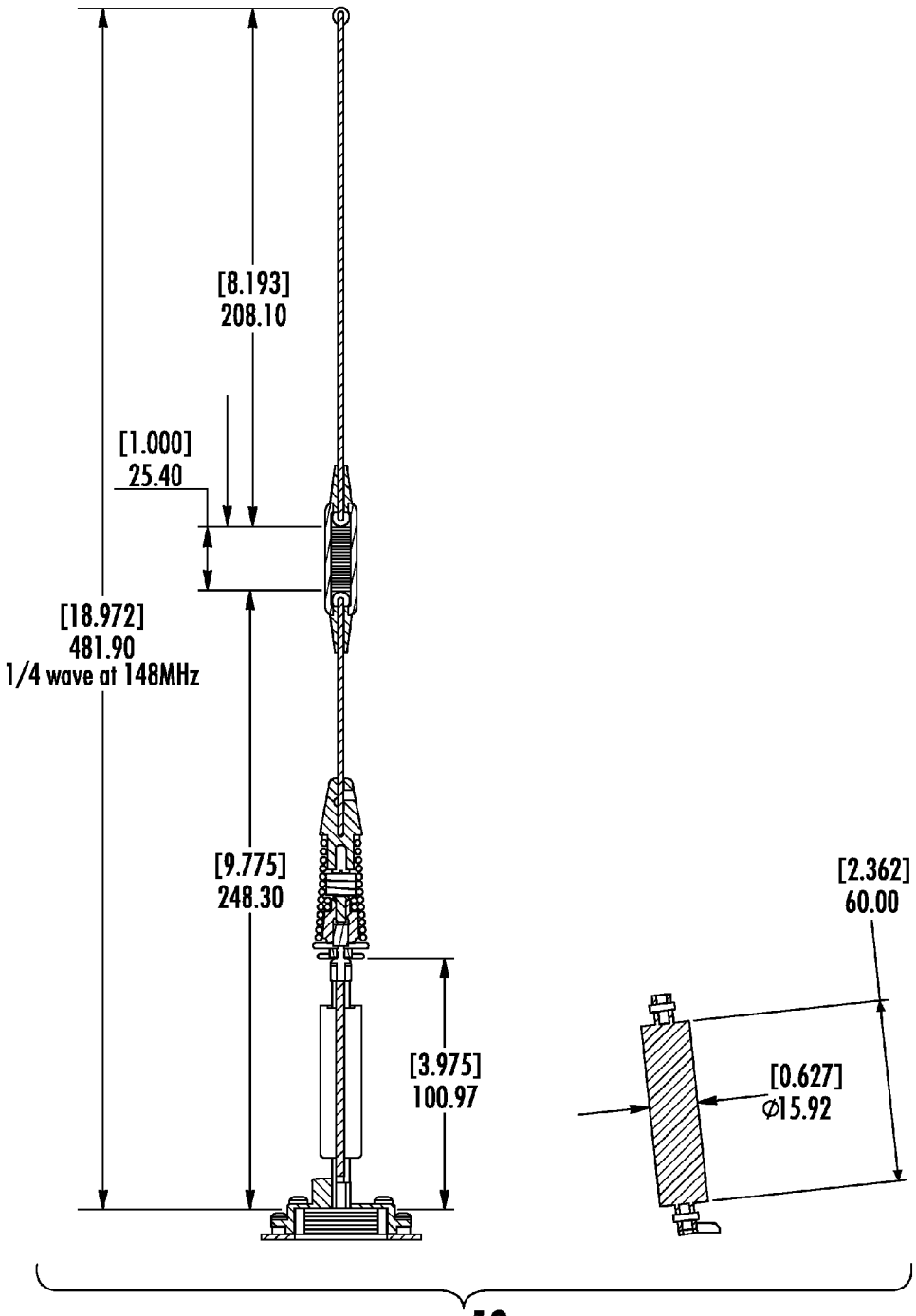
FIG. 19 illustrates the multiband antenna assembly shown in FIGS. 14 and 15 without the antenna base housing and with the phase coil housing shown in cross section, where the dimensions in millimeters [inches] are provided for purpose of illustration only according to an exemplary embodiment.
Figure 21A:
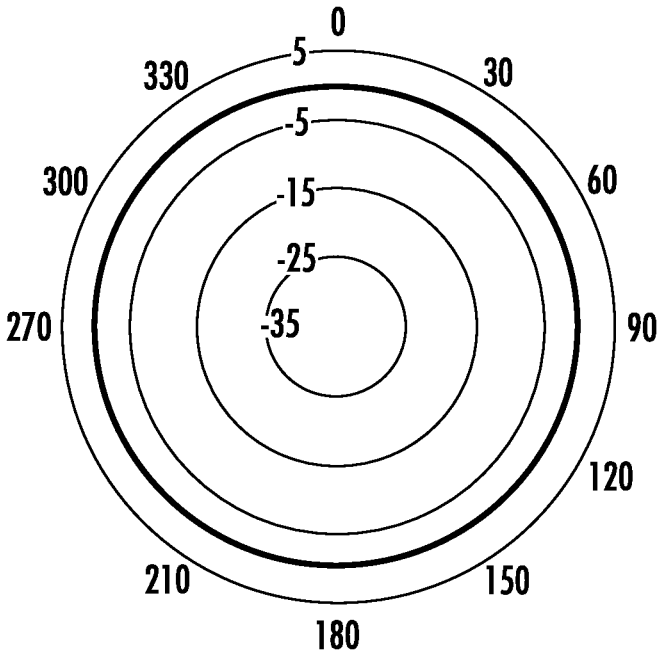
Figure 21B:
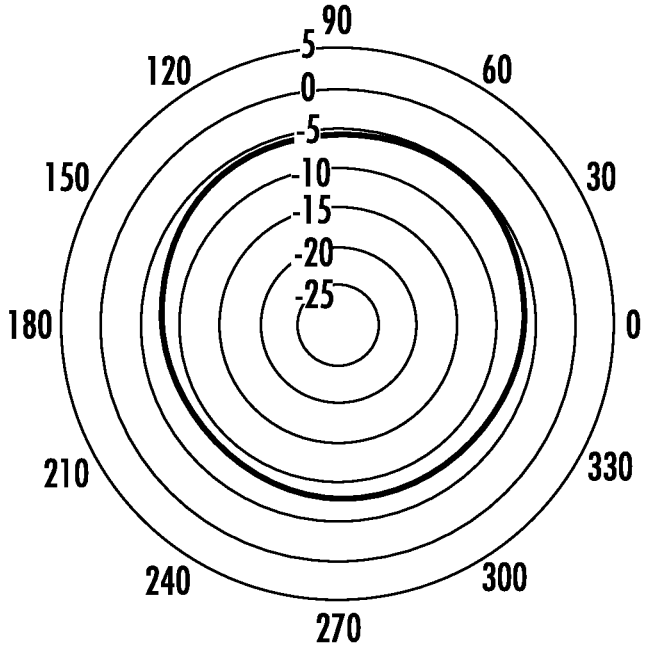
Figure 21C:
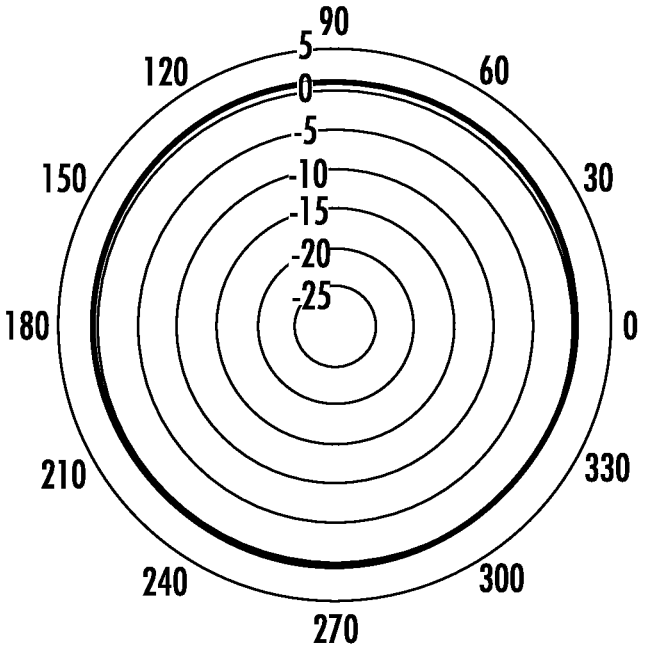
Figure 22A:
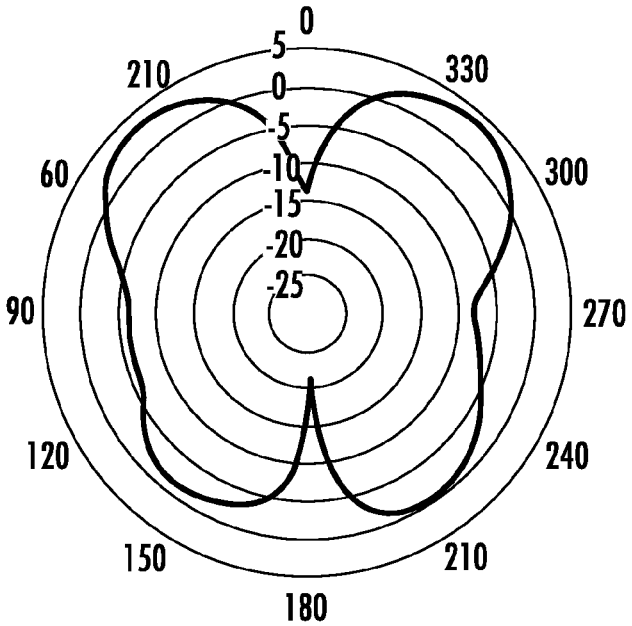
Figure 22B:
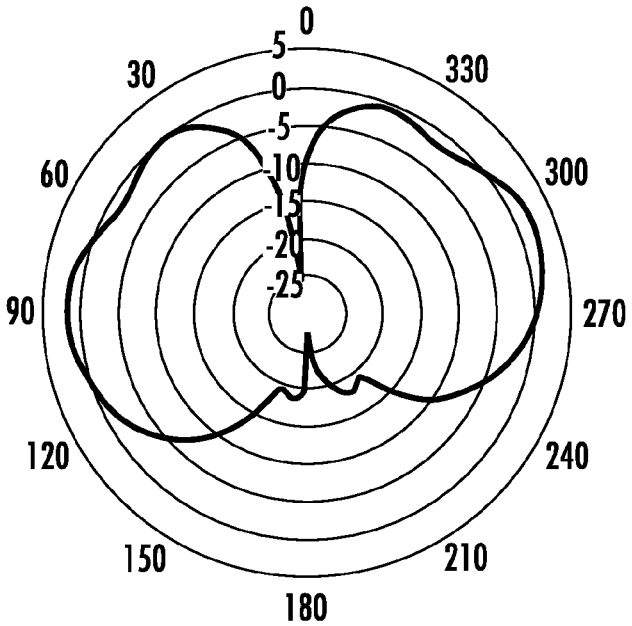

FIGS. 21A, 21B, and 21C illustrate azimuth field radiation patterns measured for a prototype of an antenna assembly having features and dimensions shown in FIG. 19 at frequencies of 156 MHz, 450 MHz, and 810 MHz; and FIGS. 22A and 22B illustrate elevation field radiation patterns measured for a prototype of an antenna assembly having features and dimensions shown in FIG. 19 at frequencies of 450 MHz and 810 MHz.

DETAILED DESCRIPTION

Example embodiments will now be described more fully with reference to the accompanying drawings.

Disclosed herein are exemplary embodiments of spring contact assemblies suitable for providing a solderless connection between a printed circuit board (PCB) and a contact. In an exemplary embodiment, a spring contact assembly may be used to provide a solderless connection between a center contact (e.g., pin, etc.) of an external antenna mount and an internal antenna element on a PCB of a multiband antenna assembly. In such exemplary embodiment, the spring contact assembly thus may be used as a connecting device to physically interconnect (without soldering) the center contact from the external antenna mount to the internal antenna element, such that radio frequency (RF) signals, electrical current, and/or modulated RF signals may be transferred (transmitted, or received) via the spring contact assembly between the multiband antenna assembly and a radio device coupled to the antenna mount, such as via a coaxial cable. Additional aspects of the present disclosure also include methods of connecting a center contact from an external antenna mount to an internal antenna element of a printed circuit board without soldering.

In addition to the spring contact assemblies disclosed herein, there are also disclosed exemplary embodiments of sealed antenna base assemblies. The sealed antenna base assemblies may be used individually or in conjunction with a spring contact assembly, or either may be used individually. Accordingly, an antenna assembly may include either or both of a sealed antenna base assembly and/or a spring contact assembly according to aspects of the present disclosure.

Multiband antenna structures commonly include PCBs, which require electrical ground sources. Typically, the ground sources are fed at deferent locations at the base of the PCB. Conventionally, grounding sources have been made available but the inventors hereof have recognized that such conventional methods breached the base of the antenna sacrificing the moisture and water seals. Accordingly, the inventors hereof have disclosed antenna base assemblies that provide the ground sources for the PCB while also maintaining a sealed base (e.g., a moisture, water, and/or dust sealed base, etc.). In an exemplary embodiment, there is an internal radiating element sealed foundation inside an antenna structure, which functions as an adaptor to mate an external antenna mount into the feeding point of a radiating element. This exemplary embodiment provides satisfactory multiple electrical grounding sources while preserving the sealing features. Additional aspects of the present disclosure also include methods of providing multiple electrical grounding sources for a printed circuit board without breaching the seal(s) of an antenna base assembly, thereby preserving the sealed interior of the antenna base assembly in which the printed circuit board is housed.

Additionally, there are also disclosed exemplary embodiments of antenna base body assemblies for multiband antennas. For example, an exemplary embodiment of a base body assembly is configured to provide or have a unique matching network structure operable for providing impedance matching and that works simultaneously with a wide band frequency spectrum (e.g., VHF 136-174 MHz, UHF 380-520 MHz, and Cell/LTE 700/800 MHz), supplementing a single Aerial structure of broadband coverage. In pursuing a balance of antenna aesthetic look, performance, and low cost on the LMR (Land, Mobile, Radio) realm, the inventors hereof sought to develop and disclose herein an exemplary embodiment of a single full spectrum antenna operable with VHF 136-174 MHz, UHF 380-520 MHz, and Cell/LTE 700/800 MHz in an overall antenna package that may be less than 20 inches in height and that has a relatively small base as a mechanical support for mounting on a standard vehicle for public safety wireless applications. As disclosed herein, an exemplary embodiment of an antenna assembly includes a vertically mounted mobile aerial structure. A primary aerial whip assembly is coupled or mounted to a base body assembly. The base body assembly may include a hermetically sealed housing and a base cap. The base body assembly may be encompass or be configured so as to provide a unique matching network. The primary aerial whip assembly may include a shock absorbing spring mounted to or coupled to the base body assembly. The primary aerial whip assembly may also include two metal rods top mounted to the shock absorbing spring. A radio wave impedance matching helical spring (or phasing coil) electrically connects and linearly joins the two metal rods with a separation or spaced distance between the two rods. An aerial radio waves defusing metal ball is coupled (e.g., via a press fit, etc.) to an upper portion of the top linearly mounted rod. For example, the top linearly mounted rod may be pressed into an opening or hole in the aerial radio waves defusing metal ball.

With reference now to the figures, FIGS. 1 through 8 illustrate an exemplary embodiment of a spring contact assembly 100 embodying one or more aspects of the present disclosure. As disclosed herein, the spring contact assembly 100 may be used in a multiband antenna assembly (e.g., multiband antenna assembly 390 shown in FIG. 12, multiband antenna assembly 490 shown in FIGS. 13 and 14, etc.) to provide a solderless connection between a printed circuit board (PCB) 124 (FIG. 2) (broadly, a substrate) and a center contact of an external antenna mount (e.g., center contact 397 of antenna mount 396 shown in FIG. 12, etc.). The spring contact assembly 100 may be used in conjunction with a sealed antenna base assembly, such as the sealed antenna base assembly 250 shown in FIG. 9. But the spring contact assembly 100 may also be used with other antenna base assemblies and/or other antenna assemblies than what is disclosed herein.

Figure 2:
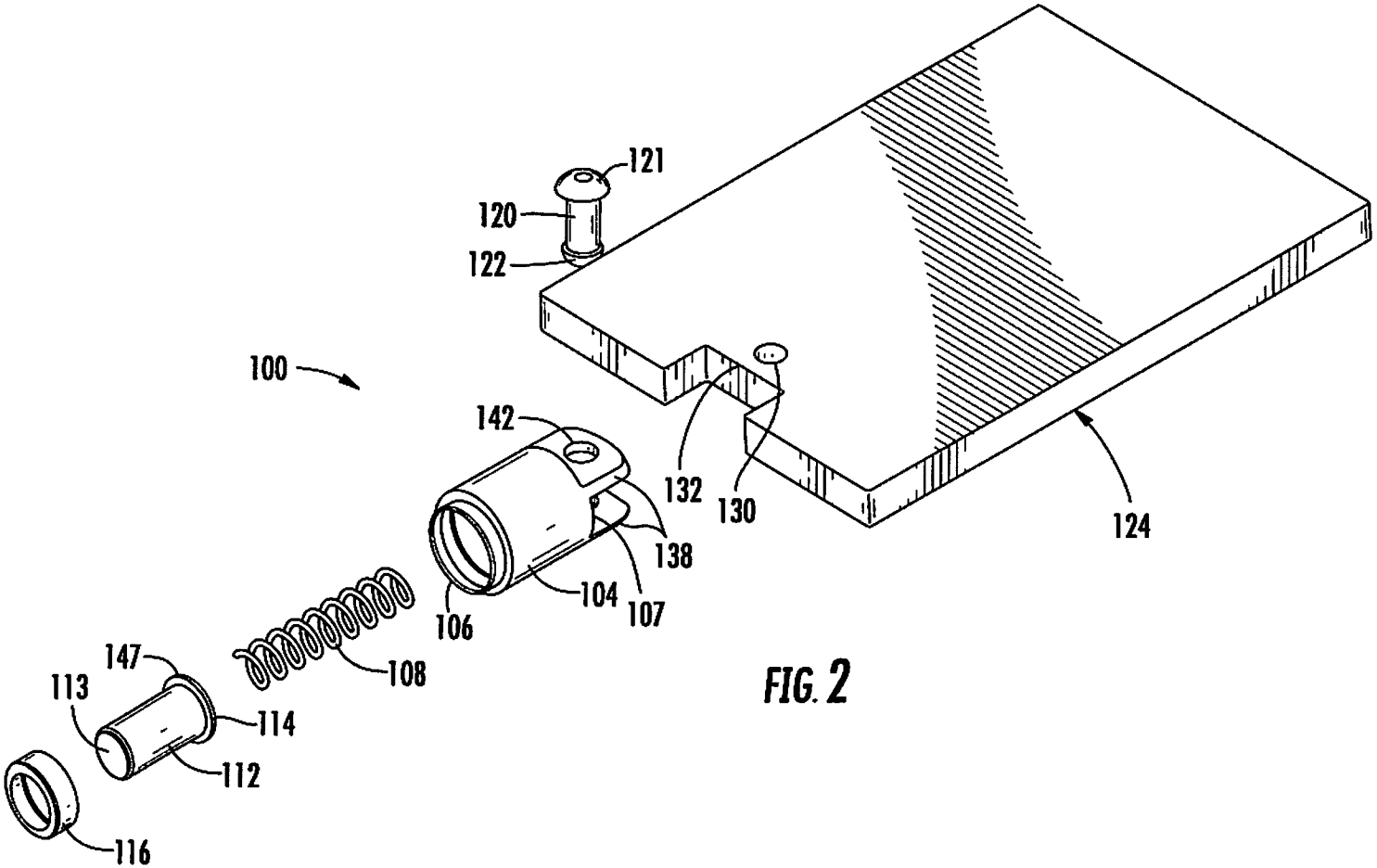
FIG. 2 is an exploded perspective of the spring contact assembly shown in FIG. 1, and also illustrating an exemplary PCB configured for use with the spring contact assembly according to an exemplary embodiment.
Figure 3:
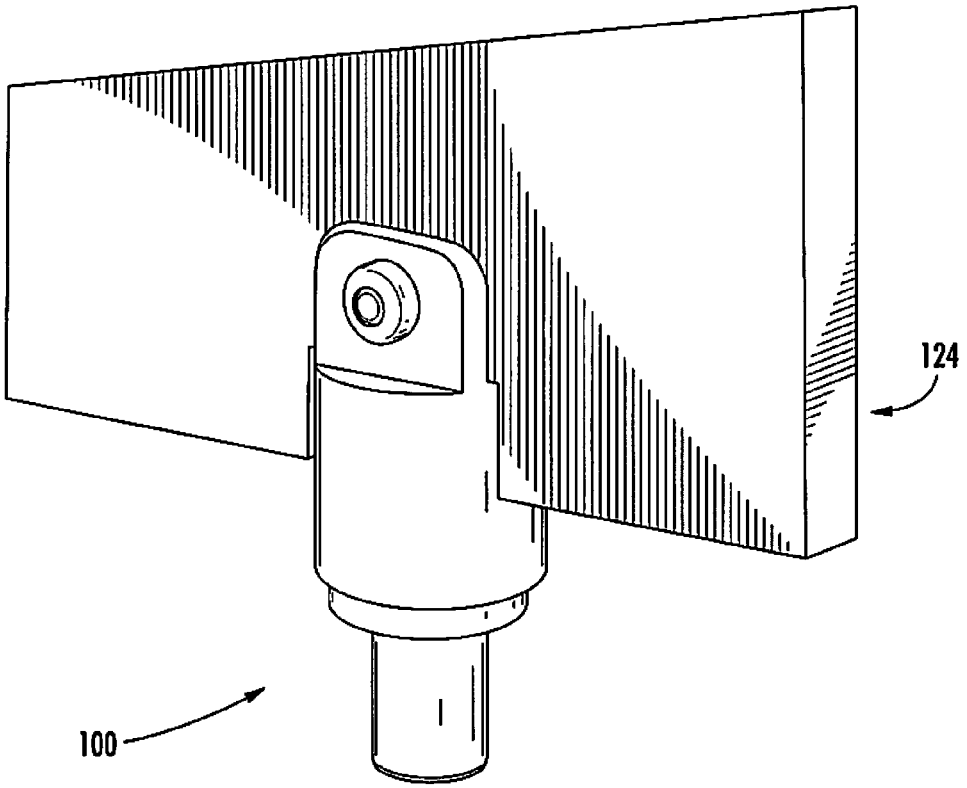
FIG. 3 is a perspective view illustrating the spring contact assembly coupled to the PCB shown in FIG. 2.
Figure 4:
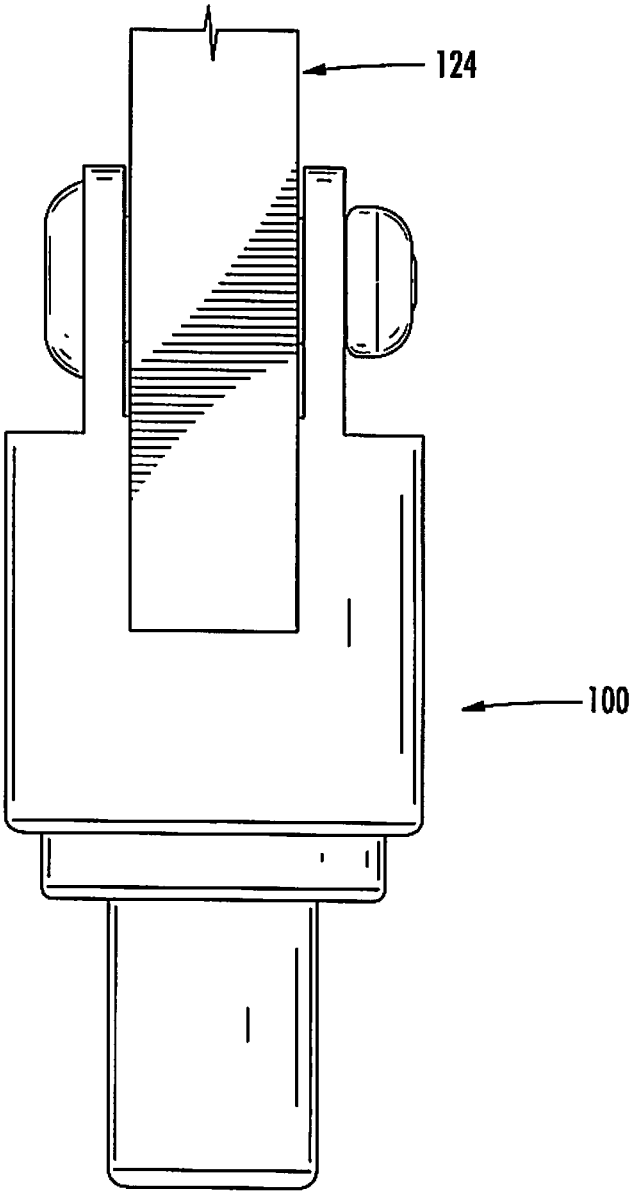
FIG. 4 is a side view of the spring contact assembly and PCB shown in FIG. 3.
Figure 5:
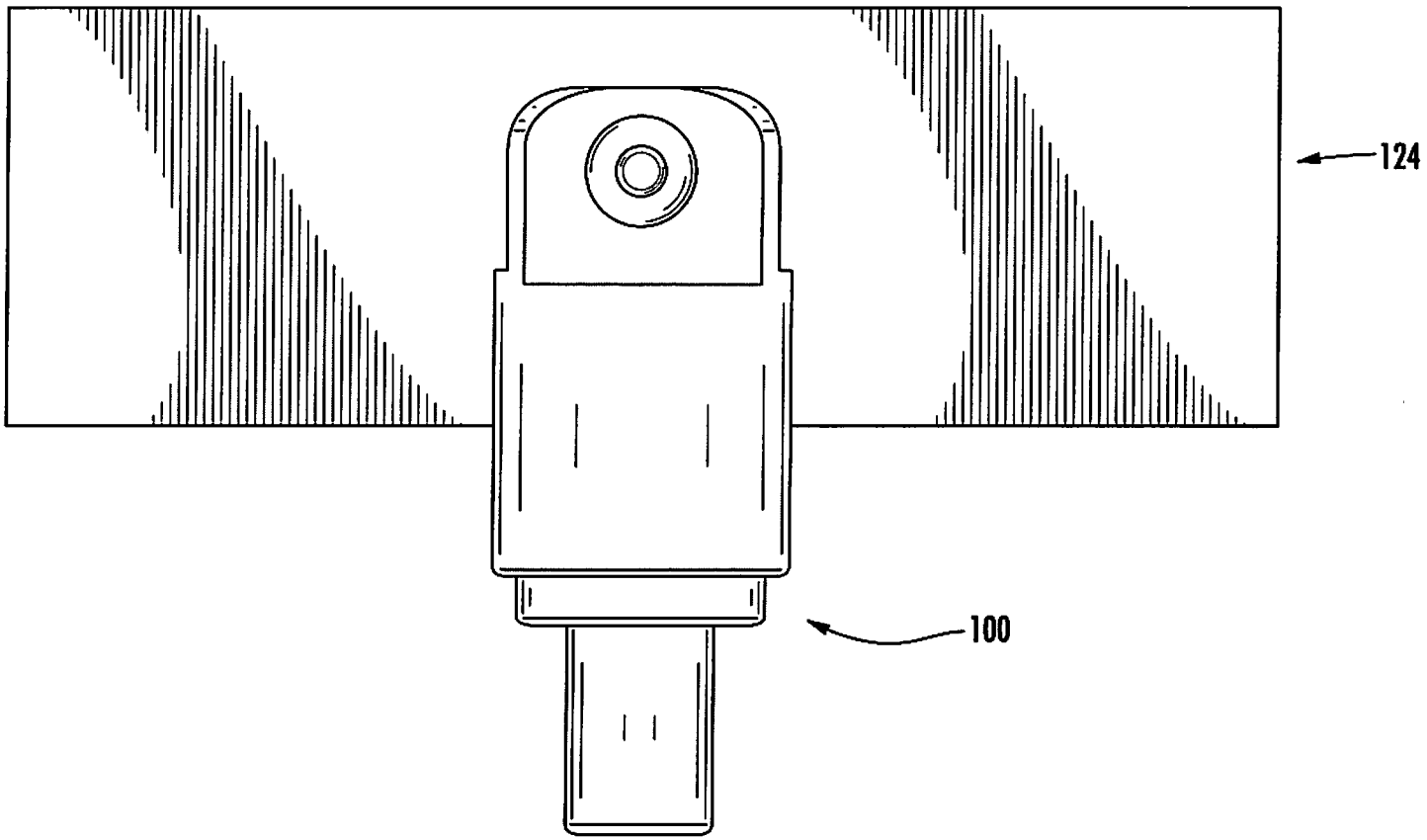
FIG. 5 is a top view of the spring contact assembly and PCB shown in FIG. 3.
Figure 6:
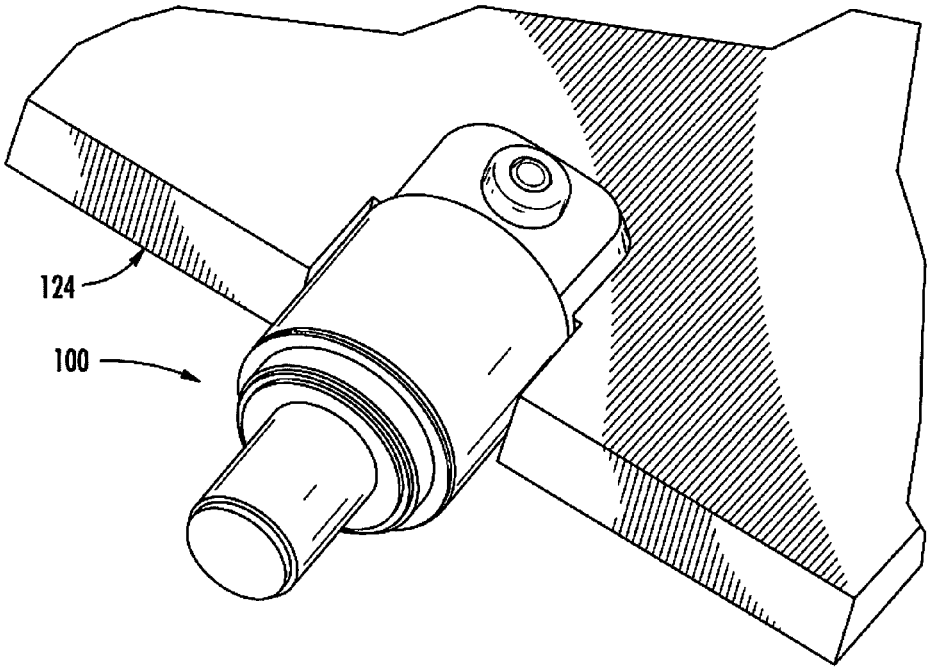
FIG. 6 is a lower perspective view of the spring contact assembly and PCB shown in FIG. 3.

As shown in FIG. 2, the spring contact assembly 100 generally includes a body 104, a spring 108 (broadly, a biasing member), a housing 112 (broadly, contact member), a bearing 116 (broadly, ring or annular member), and a rivet or pin 120 (broadly, a fastener or locking member). FIG. 2 also illustrates the exemplary PCB 124, which is provided with a hole or opening 128 configured for receiving the rivet 120 therein. The PCB 124 also includes a notch or cutout area 132 configured to accommodate positioning of portions 138 of body 104 about the opposite sides of the PCB 124. With this relative positioning, the holes 142 in the body's portions 138 may be aligned with the hole 130 in the PCB 124 for receiving the rivet 120 therethrough.

Figure 7:
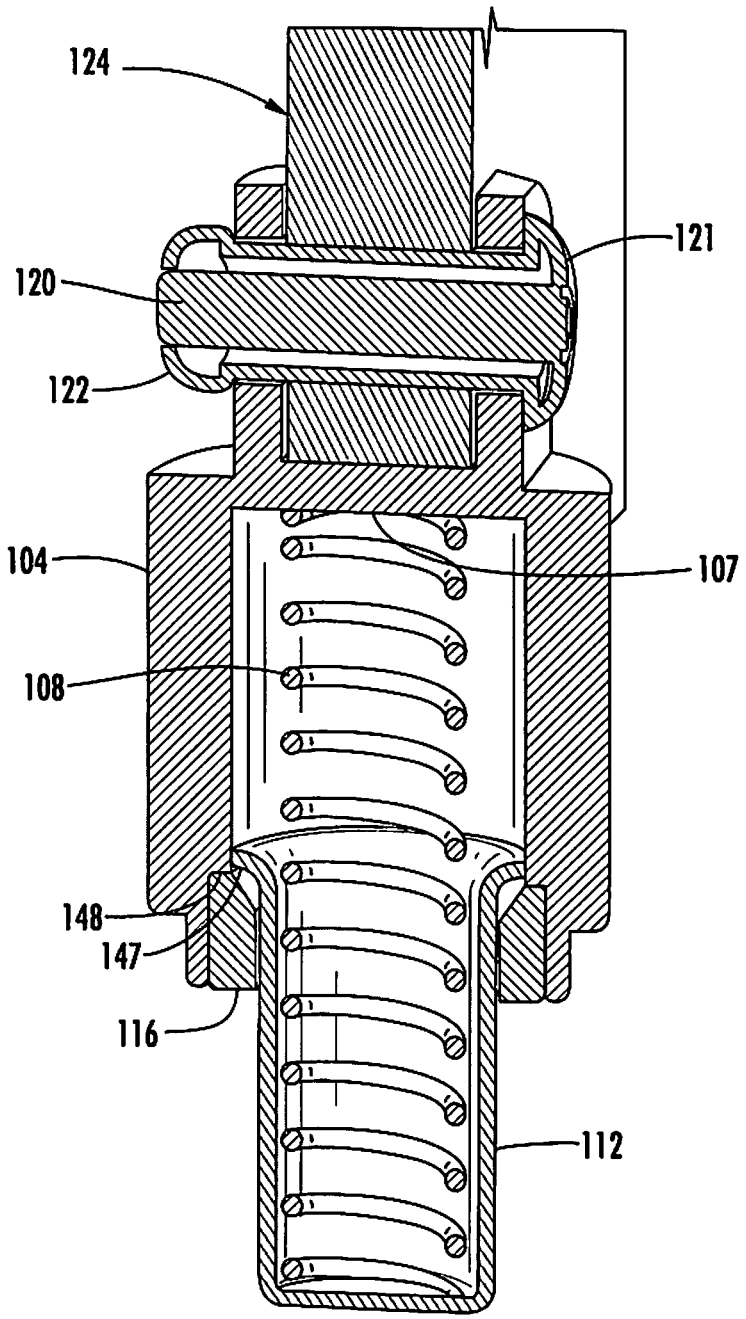
FIG. 7 is a cross sectional view of the spring contact assembly and PCB shown in FIG. 3, and illustrating the spring in an uncompressed, relaxed condition.

When the holes 130, 142 are aligned, the rivet 120 may be positioned through the aligned holes 128, 130 to thereby connect or lock the spring contact assembly 100 to the substrate, board or body of the PCB 124 as shown in FIG. 7. The body's portions 138 and/or rivet 120 may electrically connect with (e.g., galvanically contact, etc.) one or more electrically-conductive portions (e.g., feeding point, radiating element, traces, etc.) of the PCB 124.

Figure 12:
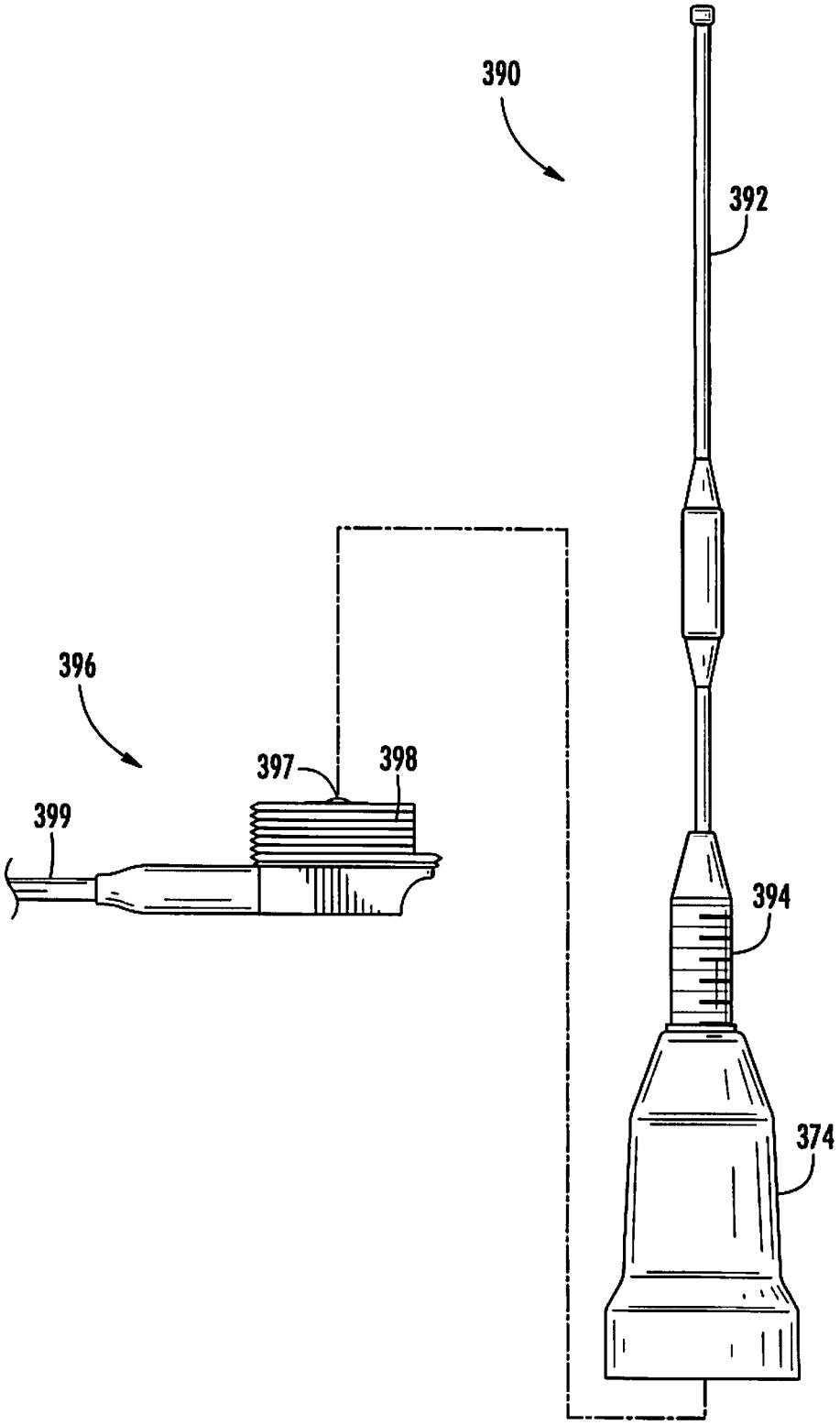
FIG. 12 illustrates an exemplary multiband antenna assembly including the spring contact assembly shown in FIG. 1, the antenna base assembly shown in FIG. 9, and an exemplary external mobile antenna mount according to an exemplary embodiment.

With the spring contact assembly 100 coupled to the PCB 124 via the rivet 120, the other end of the spring contact assembly 100 may be used to physically interconnect or electrically connect with a contact, such as a center contact of an external radio antenna mount (e.g., center contact 397 of antenna mount 396 shown in FIG. 12, etc.). By way of example, the spring contact assembly 100 may connect or mate the center contact of the antenna mount with a feeding point of a radiating element on the PCB 124. In which case, the spring contact assembly 100 may then be used for transferring, transmitting, and/or receiving radio frequency (RF) signals, electrical current, and/or modulated RF signals between an external device (e.g., radio unit connected to the antenna mount 396 via a coaxial cable 399, etc.) and the antenna assembly (e.g., 390 (FIG. 12), 490 (FIGS. 13 and 14), etc.) including the spring contact assembly 100.

FIG. 7 illustrates the spring 108 in its initial relaxed, uncompressed condition within the respective open end portions 106, 114 of the body 104 and housing 112 between their respective closed end portions 107, 113. But when the spring contact assembly 100 is assembled between the PCB 124 and the external radio antenna mount, the housing 112 moves or slides at least partially along, within, or into the open end portion 106 tubular body 104 of the spring contact assembly 100 as shown by a comparison of FIGS. 7 and 8. This relative sliding movement of the housing 112 into the body 104 compresses the spring 108 (FIG. 8) between the interior surface of the closed end portion 113 of the housing 112 and the interior surface of the closed end portion 107 of the body 104. With this compression, the spring 108 is operable for providing a biasing force for urging the housing 112 to slide relative to the body 104 in a direction generally away from the closed end portion 107 of the body 104. Accordingly, the spring 108 is thus operable for biasing, pressure loading, or spring loading the housing 112 and its end portion 113 (e.g., contact pin, etc.) into good electrical contact with a center contact of an antenna mount. At which point, the spring contact assembly 100 may thus transfer signals or electrical current between the antenna mount center contact and the PCB 124.

With continued reference to FIG. 2, the various components of this illustrated embodiment of the spring contact assembly 100 will now be described in more detail for this example. The body 104 is cylindrical and electrically-conductive. The body 104 also includes an open end portion 106 and a closed end portion 107. The body 104 also includes generally flat spaced-apart portions or flats 138, which protrude or extend outwardly from the closed end portion 107. These portions 138 include thru holes 142 aligned with each other for receiving the rivet 120 therethrough. The spacing between the body's portions 138 is predetermined or configured so as to be about equal to (e.g., only slightly larger) the thickness of the substrate or board of the PCB 124 to which the spring contact assembly 100 will be mounted. The body's portions 138 may be configured so as to snugly receive or grip the PCB substrate or board therebetween to thereby form an interference or friction fit. The body 104 may be made from any suitable electrically-conductive material, such as metal (e.g., brass, etc.) or other materials.

The spring 108 in this example embodiment is a helical metal compression coil spring made from a stainless steel alloy material. In operation, the spring 108 is operable for biasing or pressure loading the housing 112 and its end portion 113 into good electrical contact with a center contact of an external antenna mount. While this illustrated embodiment includes a coil spring, other suitable biasing members besides coil springs made from stainless steel alloy may be used in other embodiments.

Figure 8:
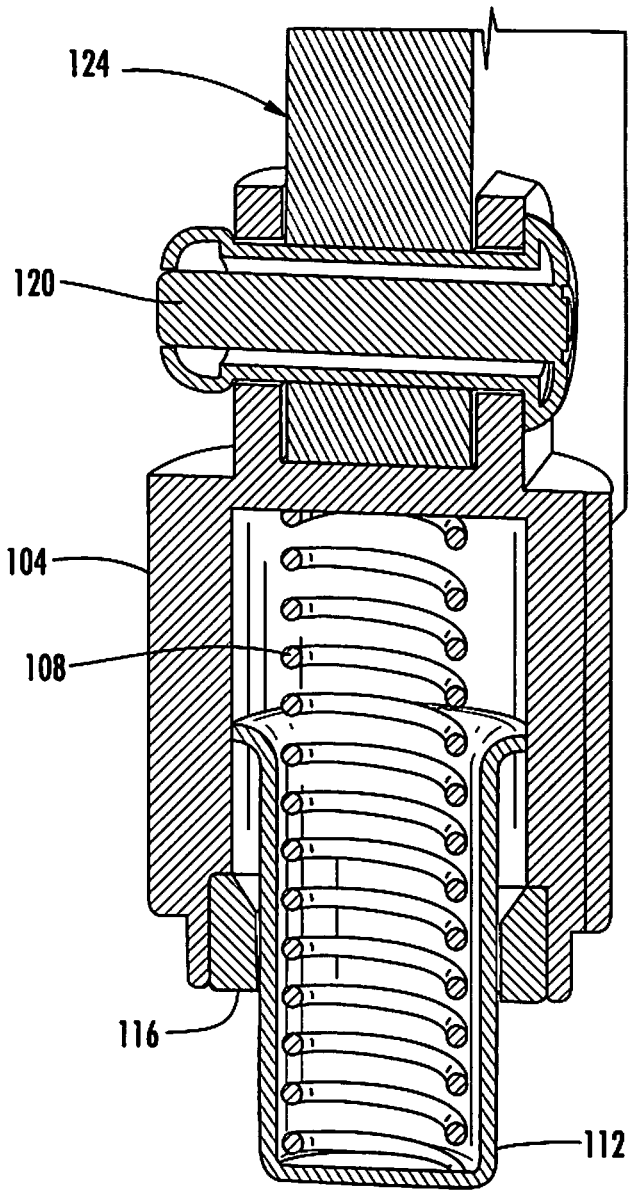
FIG. 8 is another cross sectional view of the spring contact assembly and PCB shown in FIG. 3, but now illustrating the spring in compressed condition.

The housing 112 includes a closed end portion 113 and open end portion 114 for receiving the spring 108 therein as shown in FIGS. 7 and 8. The closed end portion 113 is biased by the spring 108 when compressed (FIG. 8) so that good electrical contact is established and maintained with a center contact of an external antenna mount. In this example, the housing 112 includes a cold drawn cup or cup-shaped member made from brass sheet metal and plated with gold for the purpose of corrosion resistance and maintenance of long term surface contact transitioning RF electrical current. The housing 112 includes a rim or lip 147 that is larger than the central opening of ring or annular member 116, such that the housing 112 is retained to the body 104 and cannot be completely slid out of the body 104.

While this illustrated embodiment includes a cup-shaped cold drawn housing 112 from brass sheet metal plated with gold, other embodiments may include housings with a different configuration, such as housings formed from other materials and/or other manufacturing processes.

Also in this illustrated embodiment, the ring or annular member 116 is a bearing that is inserted into the body 104 so as to provide a bearing surface for rotary and linear movement of the housing 112 relative to the bearing 116 and body 104. The annular member 116 also prevents or at least inhibits the housing 112 from being slid completely out of the body 104. The bearing 116 may be coupled to the inner walls of the body 104 via mechanical compression, interference/friction fit, or other suitable method. As shown in FIG. 7, the bearing 116 is in abutting contact with an internal shoulder 148 of the body 104.

In this example, the rivet 120 is used as a mechanical fastener that couples the spring contact assembly 100 to the PCB 124. The rivet 120 is a permanent or fixed mechanical fastener in this example that is not removable from the holes of the PCB 124 and body 104 after installation. Before being installed, the rivet 120 includes a smooth cylindrical shaft with a head 121 on one end (FIG. 2). The end opposite the head 121 is called the buck-tail 122. During installation, the rivet 120 is placed in the aligned holes 128, 142. Then, the tail 122 of the rivet 120 is upset, bucked, or deformed (as shown by FIG. 7) so that it expands (e.g., to about 1.5 times the original shaft diameter, etc.) thus holding the rivet 120 in place as both ends 121, 122 are larger than the holes 128, 142 thus preventing the rivet 120 from being removed from the holes 128, 142. To distinguish between the two ends 121, 122 of the rivet 120, the original head is called the factory head 121 and the deformed end is called the shop head or buck-tail 122. While this illustrated embodiment includes the rivet 120 for coupling the spring contact assembly 100 to the PCB 124, other embodiments may include other fasteners besides rivet 120.

Regarding the PCB 124, it may include a substrate or board body made of FR4 or other suitable material. The PCB 124 includes one or more antenna radiating elements (e.g., electrically-conductive traces, etc.) configured to be operable and resonant in one or more frequency ranges or bands, such as a very high frequency (VHF) band from 136 Megahertz (MHz) to 174 MHz, an ultra high frequency (UHF) band from 380 MHz to 520 MHz, and/or a 700/800 MHz band from 760 MHz to 870 MHz. These frequency bands are examples only as other exemplary embodiments may include a PCB with one or more antenna radiating elements configured to be operable and resonant at other frequencies and/or frequency bands.

In operation, the PCB 124 is operable for transmitting and receiving electrical current through a contact port physically attached to an edge of the PCB 124. Also in this illustrated embodiment, the PCB 124 is configured with a specific or predetermined shape to accommodate the installation of the spring contact assembly 100. As shown in FIG. 2, the PCB 124 includes the notch or cutout area 132 configured to accommodate positioning of the portions 138 of the body 104 about the opposite sides of the PCB 124. This positioning allows the holes 142 in the body's portions 138 to be aligned with the hole 130 in the PCB 124.

With continued reference to FIG. 7, the body 104 is used to house and control the linear movement of the housing 112. As shown in FIG. 7, the helical coil spring 108 is placed within the open end portions 106 and 114 of the body 104 and housing 112, respectively, such that the spring 108 is inside the space or void portion between the closed end portion 107 of the body 104 and the closed end portion 113 of the housing 112. The ring 116 is pressed into the inner walls of the contact body 104 to thereby lock or retain the flanged portion 147 of the housing 112. The flat extending portions 138 of the body 104 are positioned into the PCB notch 132 such that the holes 142 of the body's portions 138 line up with the PCB hole 130. The rivet 120 is then inserted through the holes 142, 130, and then the end 122 of the rivet 120 is deployed (e.g., deformed, etc.) to lock or retain the spring contact assembly 100 onto the PCB 124.

Figure 9:
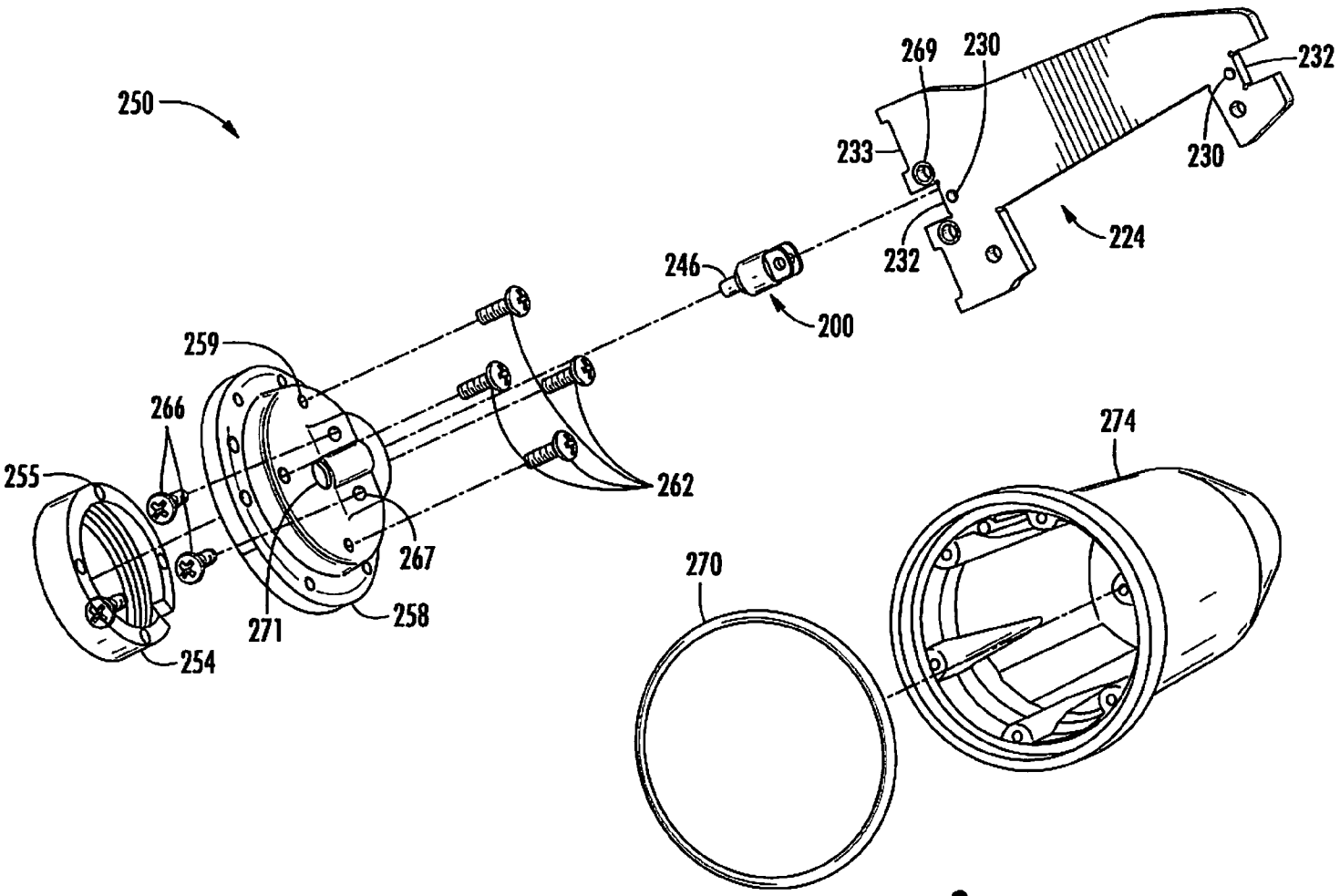
FIG. 9 is an exploded perspective view of an antenna base assembly according to an exemplary embodiment.
Figure 10:
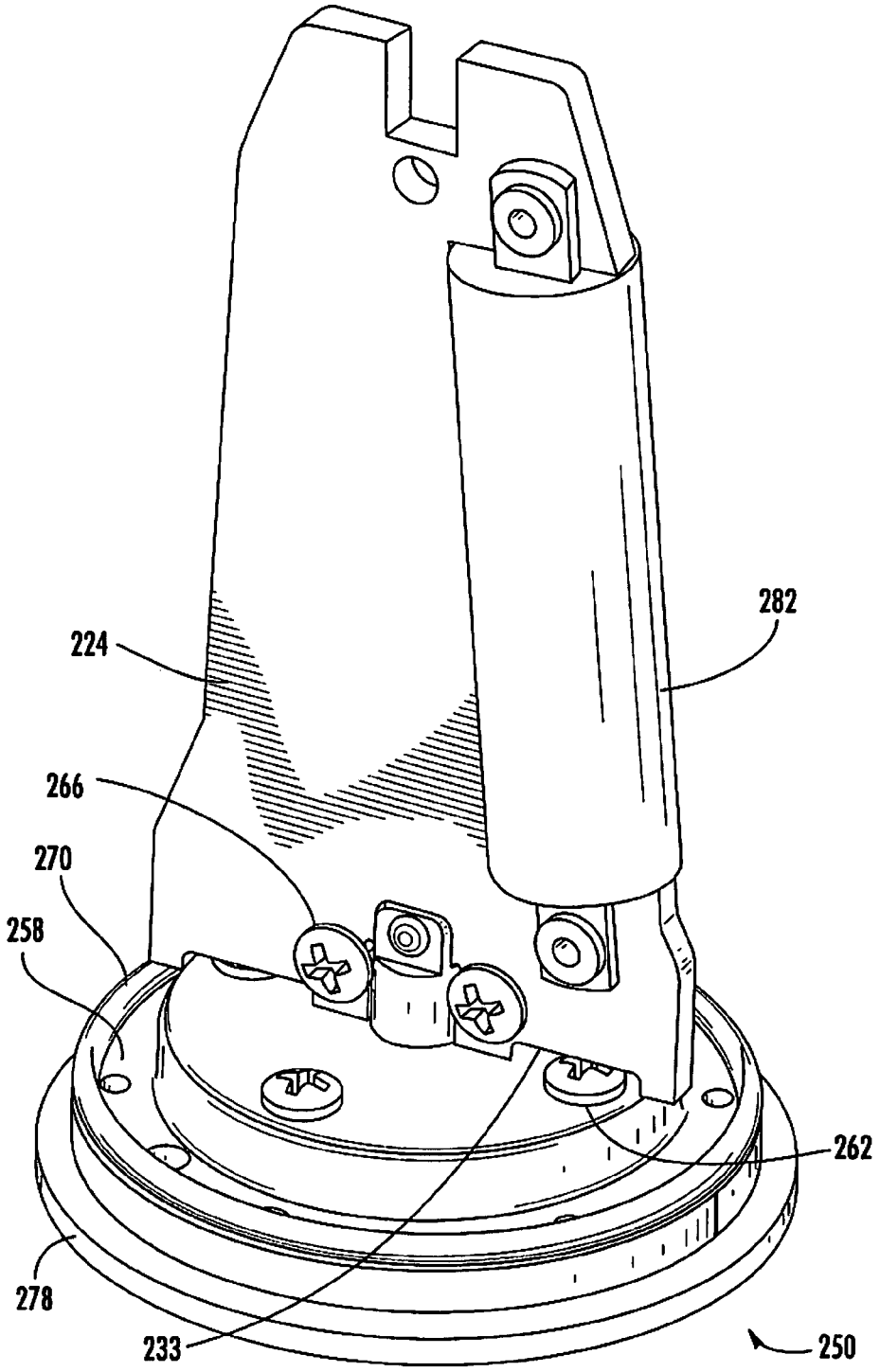
FIG. 10 is a perspective view of the antenna base assembly shown in FIG. 9 after being assembled together.
Figure 11:
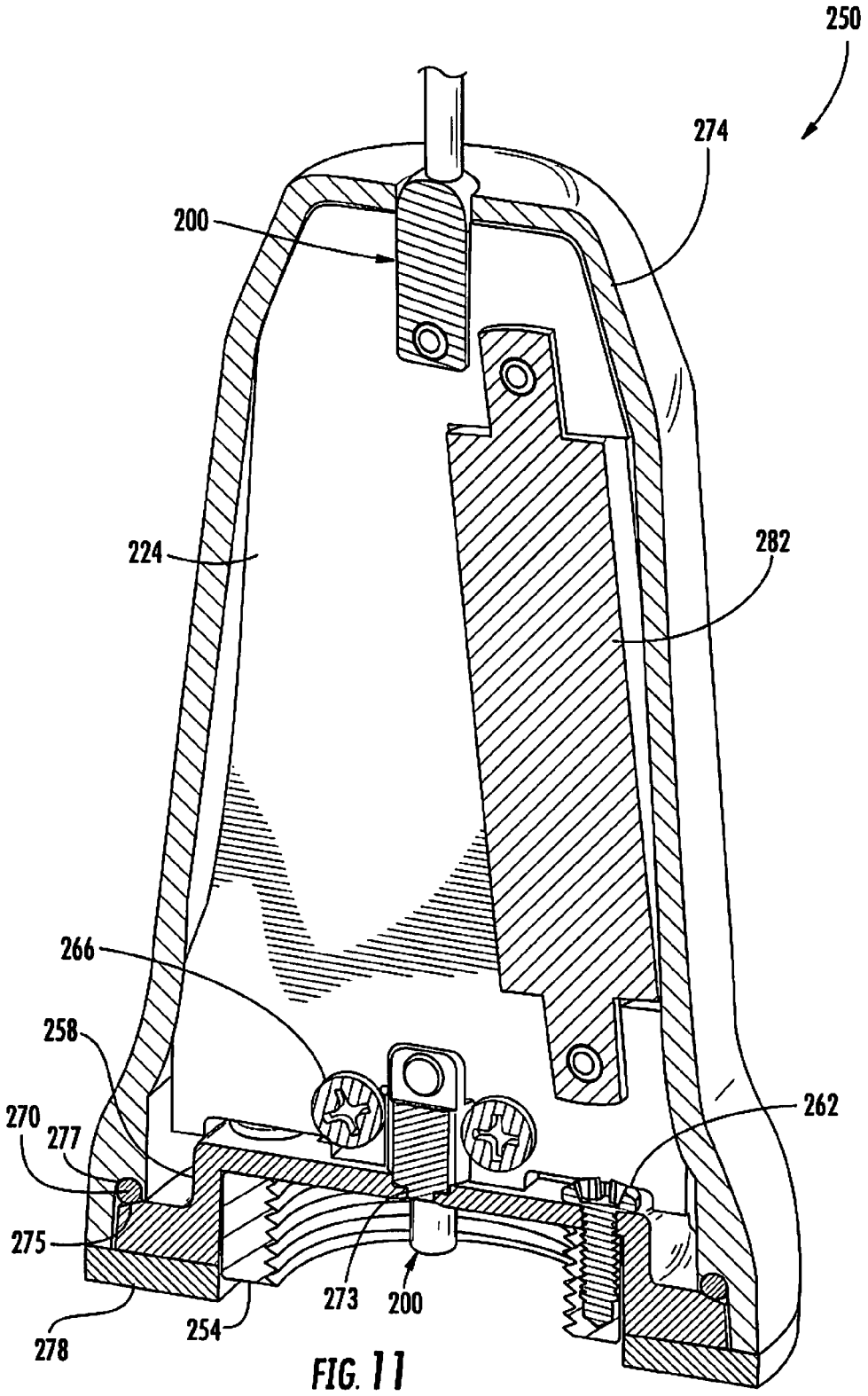
FIG. 11 is a perspective view of the antenna base assembly shown in FIG. 10 with the housing installed.

FIGS. 9 through 11 illustrate an exemplary embodiment of an antenna base assembly 250 embodying one or more aspects of the present disclosure. The antenna base assembly 250 may be used as an adaptor to mate an external antenna mount into a feeding point of a radiating element. As disclosed herein, the antenna base assembly 250 provides multiple electrical grounding sources and also maintains a sealed antenna base (e.g., a moisture and/water sealed base, etc.).

Figure 1:
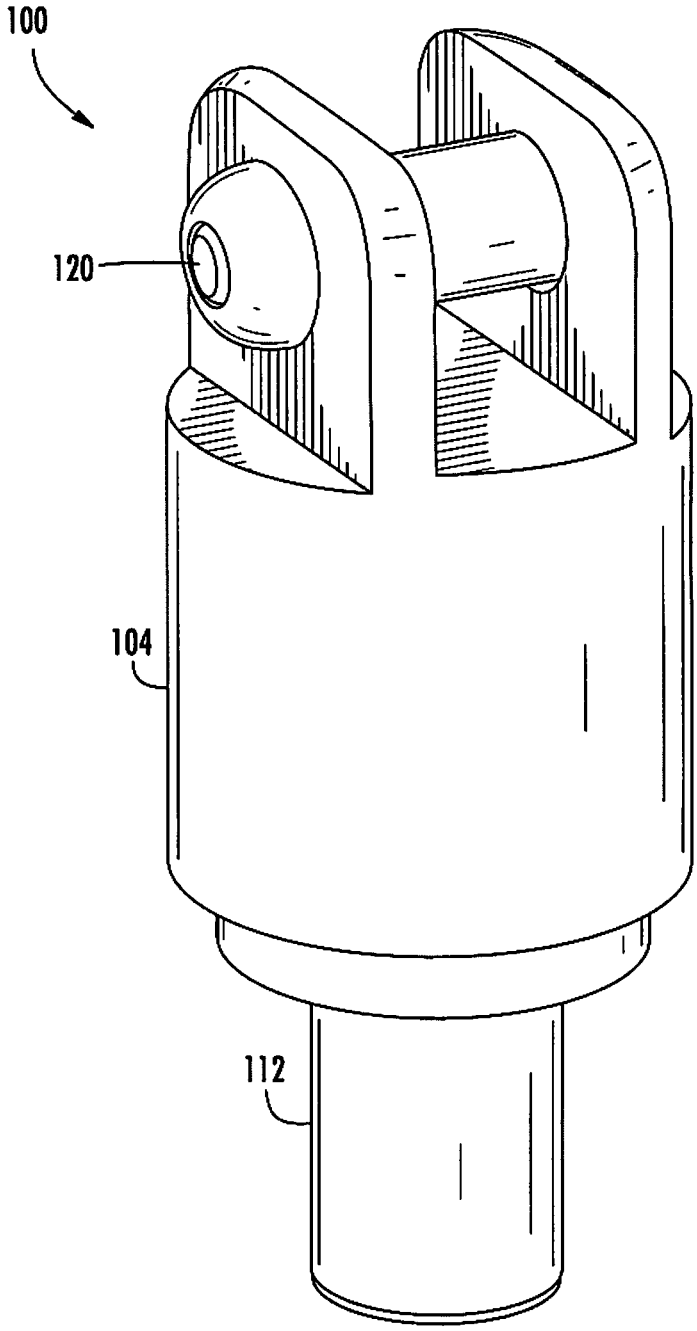
FIG. 1 is a perspective view of an exemplary spring contact assembly suitable for providing a solderless connection between a printed circuit board (PCB) and a center contact of an external antenna mount according to an exemplary embodiment.

The antenna base assembly 250 may be used in conjunction with a spring contact assembly, such as the spring contact assembly 100 shown in FIG. 1. Additionally, or alternatively, the antenna base assembly 250 may also be used with the multiband antenna assembly 390 shown in FIG. 12 and/or the multiband antenna assembly 490 shown in FIGS. 13 and 14. But the antenna base assembly 250 may also be used with other spring contact assemblies and/or other antenna assemblies than what is disclosed herein.

As shown in FIG. 9, the antenna base assembly 250 generally includes a bushing 254 (broadly, an electrically-conductive grounding member) and a base 258. The base 258 includes a seat formed in the bottom thereof for receiving the bushing 254 as shown in FIG. 11. Accordingly, the base 258 may also be referred to as a base seat.

With continued reference to FIGS. 9 through 11, fasteners 262, 266 respectively couple the bushing 254 and PCB 224 to the base 258. The antenna base assembly 250 also includes a sealing member 270 (e.g., an O-ring, gasket, etc.), a contact 200 (e.g., contact pin, spring assembly 100, etc.), and a housing or radome 274 (e.g., bell or dome shaped plastic housing, etc.).

In this illustrated example of FIGS. 9 through 11, the bushing 254 is an electrically-conductive ground bushing formed from metal or other suitable electrically-conductive material. The bushing 254 has a cylindrical, annular shape. The bushing 254 is also drilled or tapped with four threaded holes 255 on the upper side to respectively receive the four electrically-conductive fasteners 262 (e.g., metal screws, etc.). The bushing 254 is also configured (e.g., internally threaded, etc.) to mate with an antenna mount. For example, FIG. 12 illustrates an exemplary antenna mount 396 having a threaded portion 398 onto which the bushing 254 may be threaded. By way of further example, the bushing 254 may be internally threaded to mate with a mobile antenna mount, such as an MBO 3/4" NMO mount available from Laird Technologies, Inc. As another example, the bushing 254 may be internally threaded for mating to a New Motorola (NMO) antenna mount installed in a roof, trunk, hood, etc. of a vehicle.

The fasteners 262, 266 may be screws made from solderable material, such as brass, nickel-plated metal, gold-plated metal, tin-plated metal, etc. As shown by FIG. 11, the fasteners 262, 266 are used to fasten the bushing 254 and PCB 224, respectively, to the base 258. Alternatively, other embodiments may include more or less than four fasteners 262, more or less than two fasteners 266, and/or different fasteners besides metal screws for fastening the bushing 254 and PCB 224 to the base 258.

The fasteners 262 are also deployed as electrical grounding taps for the PCB 224 in this example. The fasteners 262 are configured for establishing at least a portion of an electrically-conductive grounding pathway from outside of or external to the interior enclosure of the antenna base assembly 250 and which extends into the interior enclosure. As shown by FIG. 11, the fasteners 262 extend through the holes 259 in the base 258 with the first end portions or heads of the fasteners 262 within the interior enclosure while the other or second end portions are external to the interior enclosure and inserted into holes of the bushing 254. Also, the fasteners 262 are disposed internally to or within the perimeter or footprint of the seal 270, and thus do not breach or otherwise interfere with the sealing providing by the seal 270. The fasteners 262 also do not breach or otherwise interface with the sealing provided by seals 273 or 278 either.

The fasteners 262 may be soldered directly to one or more electrically-conductive portions on the PCB 224 and/or by extending wire leads from the PCB 224 and soldering the wire leads to the ground taps/fasteners 262. In either case, an electrically-conductive grounding pathway is thus established from the PCB 224 through the fasteners 262 to the bushing 254 and then to the threaded portion of the antenna mount on which the bushing 254 is mounted.

The base 258 may be formed from various dielectric materials. By way of example, the base 258 may be an injection molded plastic part configured (e.g., shaped, sized, etc.) to accept the mating of the bushing 254 and the PCB 224. As shown in FIG. 11, the lower portion of the base 258 includes an opening, recess, or seat configured (e.g., sized, shaped, etc.) to receive the bushing 254 therein. The bushing 254 is positionable within the seat of the base 258 such that the bushing 254 is disposed and nests in the seat of the base 258 in a fixed or predetermined orientation. When the bushing 254 is positioned in the seat of the base 258, the holes 255 of the bushing 254 are aligned with holes 259 through the base 258 for receiving the fasteners 262.

The upper or top portion of the base 258 is shaped to mate with the PCB 224 aligned vertically. When the PCB 224 is positioned on the base 258 as shown in FIGS. 10 and 11, holes 267 in the base 258 align with holes 269 in the PCB 224 for receiving the fasteners 266.

The PCB 224 also includes clearances or cutout areas 233 to accommodate and provide sufficient space for the heads of the fasteners 262 as shown in FIG. 10. The PCB 224 may also include one or more antenna radiating elements (e.g., electrically-conductive traces, etc.), one or more matching networks, among other components or portions of an antenna system or network, etc. In this illustrated example shown in FIGS. 10 and 11, the PCB 224 includes an aluminum transformer balun 282, which is a part of the antenna matching circuit in this example.

In addition, the PCB 224 also includes holes or openings 230 and notches or cutout areas 232. These PCB holes 230 and notches 232 may be used similar to that described above for the PCB 124 and spring contact assembly 100. Accordingly, the spring contact assembly 200 shown in FIG. 9 may be identical in structure and/or operation as the spring contact assembly 100 shown in FIGS. 1 through 8. But other embodiments may include a spring contact assembly 200 different than spring contact assembly 100.

With continued reference to FIG. 9, the spring contact assembly 200 (e.g., spring loaded metal contact, etc.) includes an end portion 246 (e.g., a contact pin, etc.). The end portion 246 is configured (e.g., sized, shaped, etc.) to be pressed into an opening or thru hole 271 (e.g., tap hole, etc.) through a center or middle of the base 258, such that a seal or sealed interface 273 (FIG. 11) is formed between the end portion 246 and the sidewalls of the base 258 forming the hole 271. Accordingly, the seal 273 helps prevent or inhibit the ingress or migration of water, moisture, dust, etc. into the inside of the antenna hull or antenna base assembly 250. Other embodiments may include one or more sealing members, (e.g., an O-ring, a resiliently compressible elastomeric or foam gasket, caulk, adhesives, other suitable packing or sealing members, integral sealing features, etc.) for substantially sealing the hole 271 in the base, in addition to or as an alternative to the sealing provided by the end portion 246.

In addition to the sealing function in this example, positioning the end portion 246 of the spring contact assembly 200 through the opening 271 also allows it to electrically connect with a center contact or pin (e.g., center contact 397 shown in FIG. 12, etc.) of an antenna mount when the base assembly 250 is installed onto the antenna mount. In turn, the center contact of the antenna mount may be connected to an inner conductor of a coaxial cable (e.g., coaxial cable 399 also shown in FIG. 12, etc.). And, the coaxial cable may be connected to an electronic device, such as a radio device. The spring contact assembly 200 may thus connect or mate the center contact of the antenna mount with a feeding point of a radiating element on the PCB 224. In operation, the spring contact assembly 200 may thus be operable for transferring electrical current between the center contact of the antenna mount to the antenna radiating element or a network of the antenna assembly that includes the base assembly 250.

In addition to the seal 273 formed between the contact pin 246 and base 258, the antenna base assembly 250 also includes the sealing member or seal 270. In this example, the seal 270 is an elastomeric (e.g., rubber, silicone, foam, etc.) O-ring, gasket, or washer configured so as to seal an interface between the housing 274 and base 258. As shown by FIG. 11, the seal 270 is disposed in a recessed channel, groove, or seat 277 of the antenna housing 274. The seal 270 also abuts or is seated against a shoulder, rim, groove, or seat 275 of the base 258. In this exemplary manner, the seal 270 substantially seals the interface between the housing 274 and base 258, which helps prevent or inhibit the ingress or migration of water, moisture, dust, other contaminants, etc. into the interior enclosure defined between the housing 274 and base 258. Other embodiments may include one or more other sealing members, such as caulk, adhesives, other suitable packing or sealing members, etc. for substantially sealing the interface between the base 258 and housing 274. In other embodiments, sealing may be achieved by one or more integral sealing features rather than with a separate sealing mechanism.

The antenna housing 274 may be coupled to the base 258 by various suitable means, such as mechanical fasteners (e.g., screws, other fastening devices, etc.), a snap-fit connection, ultrasonic welding, solvent welding, heat staking, adhesives, latching, bayonet connections, hook connections, integrated fastening features, etc. within the scope of the present disclosure. When the housing 274 is coupled to the base 258, the seals 270 and 273 may thus help protect components against ingress of contaminants (e.g., dust, moisture, etc.) into an interior enclosure defined between the housing or cover 274 and the base 258. In this illustrated example, the antenna housing 274 is a generally bell shaped or dome shaped plastic housing. Alternative embodiments may include a differently configured housing having a different shape (e.g., aerodynamic configuration, etc.), formed from different materials, etc.

The antenna base assembly 250 may be threadedly coupled via the threaded portion of the bushing 254 to an external antenna mount. In turn, the external antenna mount may be mounted to a surface of an automobile such as the roof, trunk, hood, etc. In the illustrated example, there is shown a sealing member 278 (e.g., a weather resistant rubber or foam gasket, etc.) on the bottom of the antenna assembly 250. In some embodiment, the sealing member 278 may be adhesively attached, etc. to the bottom of the base 258 and/or housing 274.

When the antenna base assembly 250 is mounted to the antenna mount, the sealing member 278 is disposed between the mounting surface and the bottom of the antenna base assembly 250. The sealing member 278 may help prevent damage to the vehicle roof (or other mounting surface). The sealing member 278 also provides further sealing features by helping to seal the mounting area against the ingress or migration of moisture, water, dust, etc. In other embodiments, the housing 274 and/or base seat 254 may be mounted to the antenna mount and/or mounting surface without any gasket 278 between the mounting surface and the antenna base assembly.

FIG. 12 illustrates an exemplary multiband antenna assembly 390, which includes the spring contact assembly 100 (FIGS. 1-8) and antenna base assembly 250 (FIGS. 9-11). As shown in FIG. 12, the multiband antenna assembly 390 includes a shock spring 394 above the housing 374 and a whip antenna rod 392 extending thereabove. Also shown in FIG. 12 is an antenna mount 396, which generally includes a center contact 397, a threaded portion 398, and a coaxial cable 399 for connection with an external device, such as a radio unit, etc. The antenna base assembly 250 may be coupled to the antenna mount 396 by threading the bushing 254 onto the threaded portion 398 of the antenna mount 396. Also in this example, a printed circuit board (e.g., 124, 224, etc.) internal to the housing 374 may be connected to the center contact 397 and to the whip antenna rod 392 via two spring contact assemblies 100 along the bottom and top of the printed circuit board. Accordingly, the spring contact assemblies 100 may be used for transferring, transmitting, and/or receiving radio frequency (RF) signals, electrical current, and/or modulated RF signals between an external device (e.g., radio unit, etc.) and the antenna assembly 390.

The multiband antenna assembly 390 may be configured to be operable and resonant in various frequency ranges or bands, including a very high frequency (VHF) band from 136 MHz to 174 MHz, an ultra high frequency (UHF) band from 380 MHz to 520 MHz, a cell/LTE 700/800 MHz band from 764 MHz to 870 MHz. These frequency bands are examples only as other exemplary embodiments of an antenna assembly that includes a spring contact assembly 100 and/or antenna base assembly 250 may be configured to be operable and resonant at other frequencies and/or frequency bands.

Figure 13:
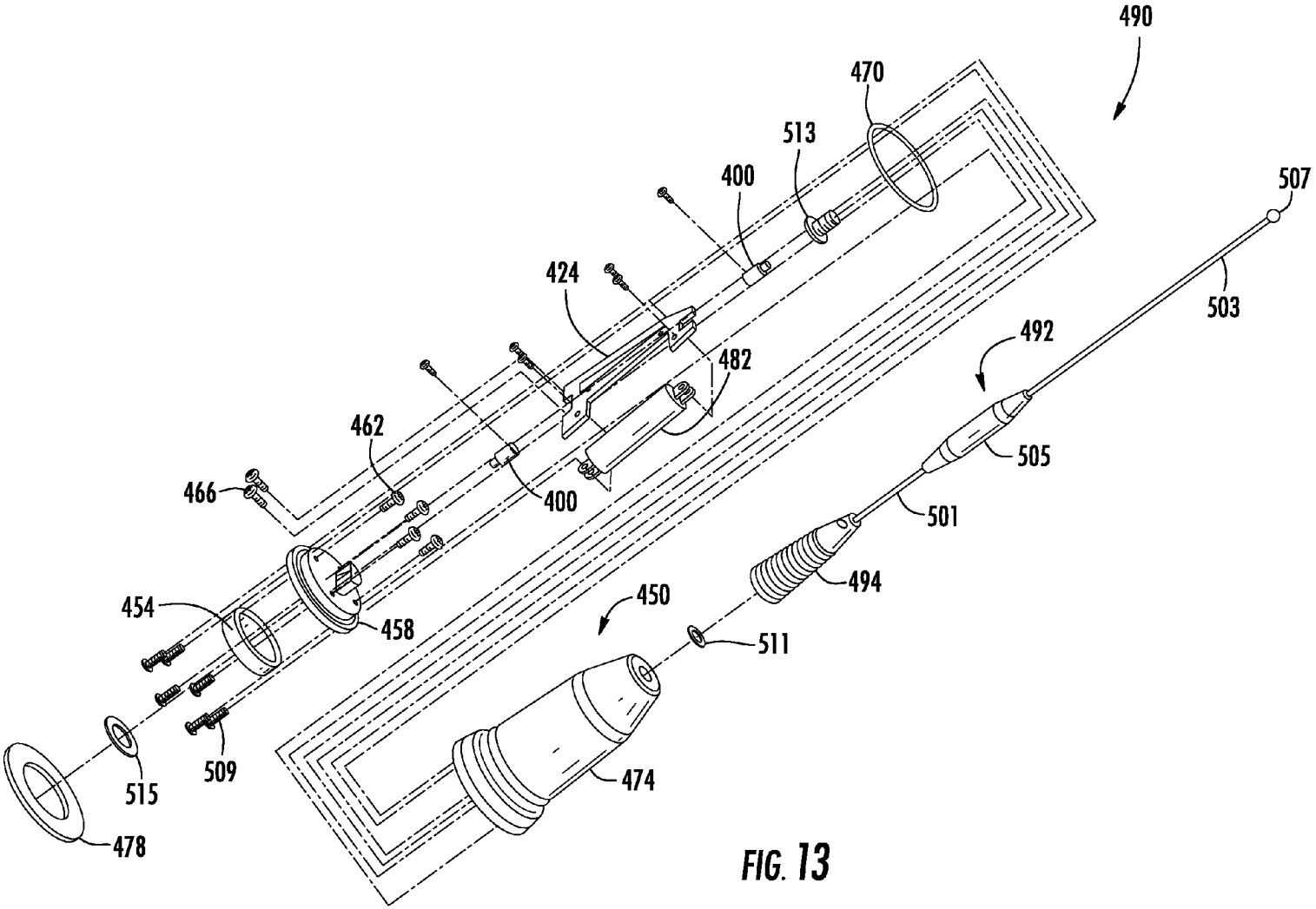
FIG. 13 is an exploded perspective view of a multiband antenna assembly according to an exemplary embodiment.
Figure 14:
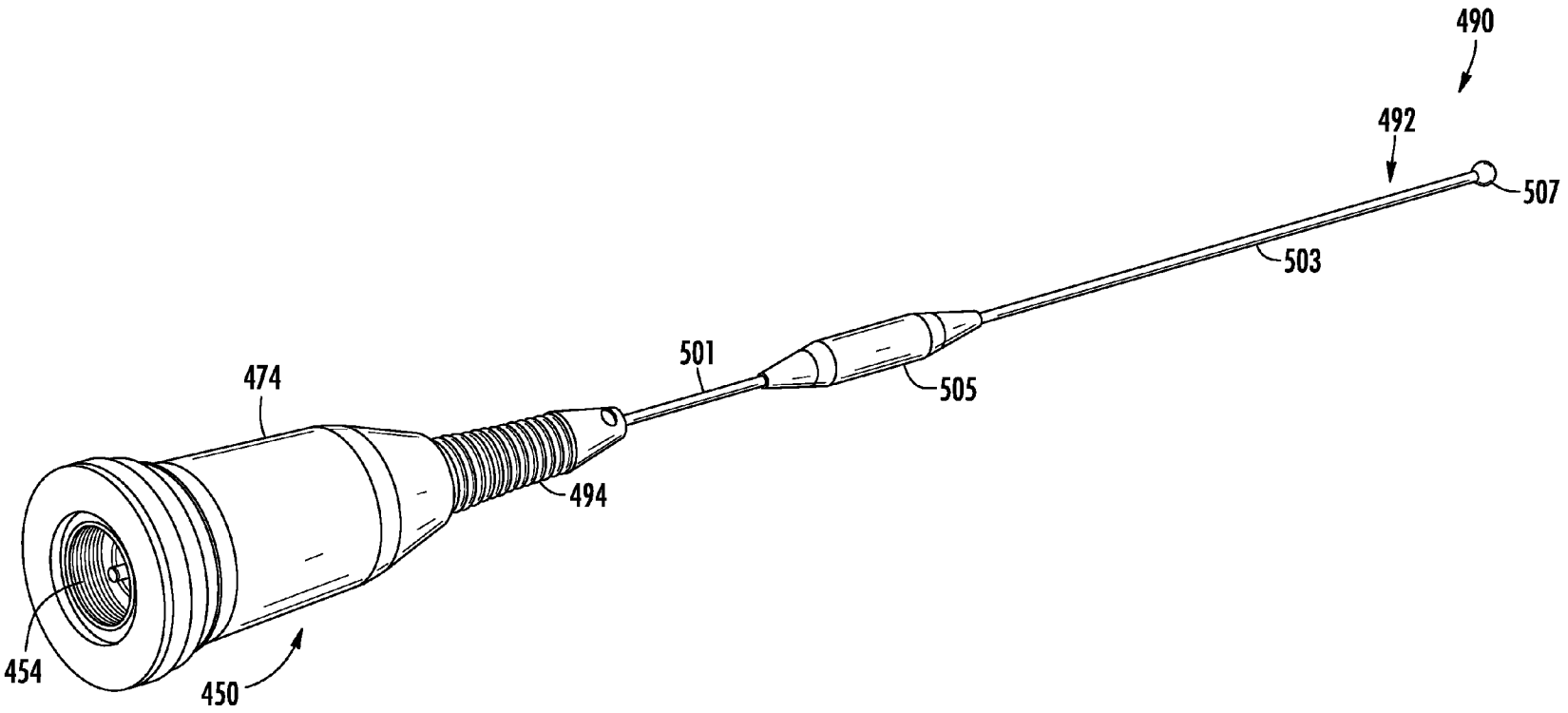
FIG. 14 is a perspective view of the multiband antenna assembly shown in FIG. 13 after being assembled.

FIGS. 13 through 19 illustrate another exemplary embodiment of a multiband antenna assembly 490 embodying one or more aspects of the present disclosure. As shown in FIG. 13, the multiband antenna assembly 490 includes a base assembly 450 and an aerial whip assembly 492 configured to be coupled or mounted to the base assembly 450.

Figure 17:
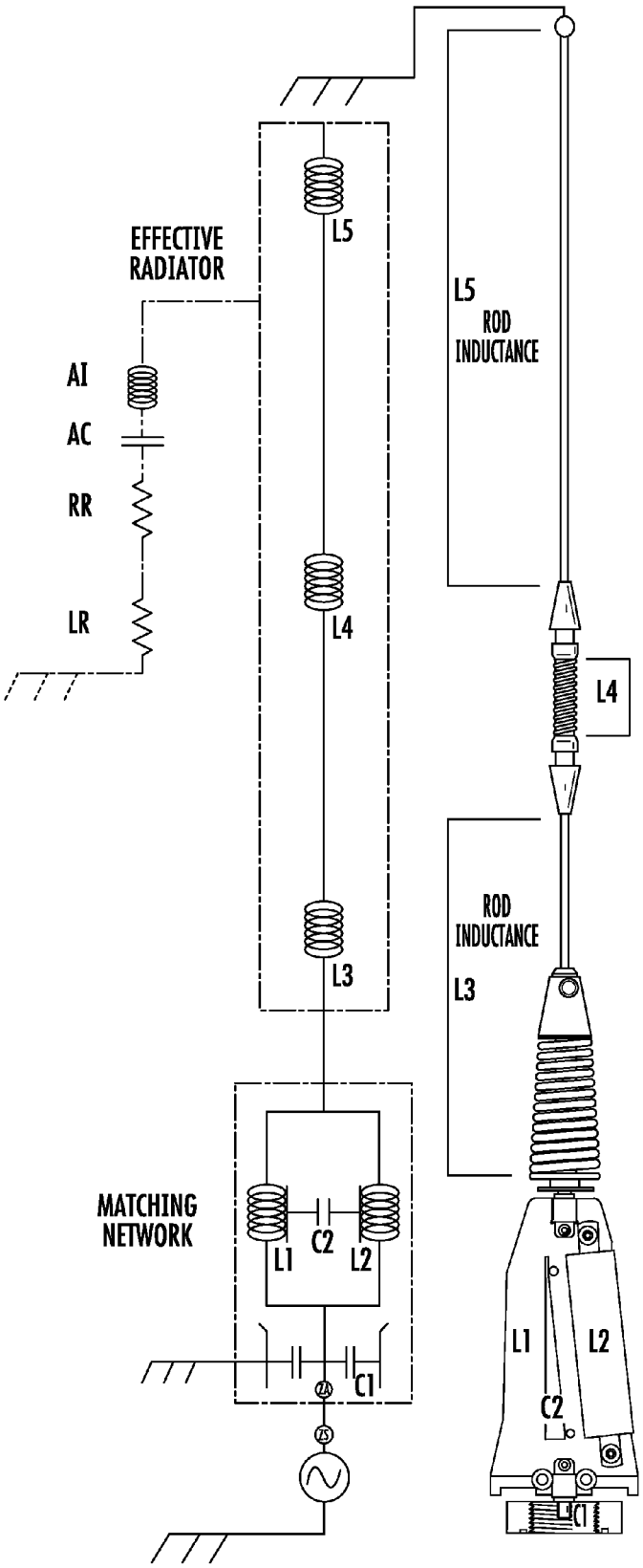
FIG. 17 illustrates the multiband antenna assembly shown in FIG. 15 side by side with a circuit diagram graphically representing the matching network provided by the base assembly and graphically representing components of the aerial whip assembly.
Figure 18:
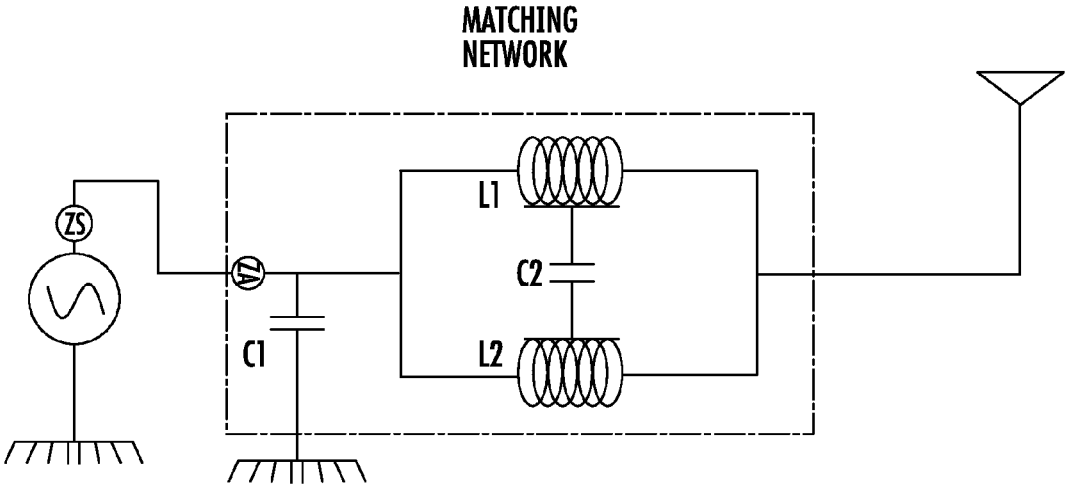
FIG. 18 is a circuit diagram graphically representing the full matching network shown in FIG. 17 provided by the base assembly, including the concentric capacitance (C2) between first and second inductors (L1 and L2) and the capacitances from ground (C1)

The base assembly 450 includes a printed circuit board (PCB) 424 and balun 482 configured so as to provide an impedance matching network structure as shown in FIGS. 17 and 18 and described herein. In this exemplary embodiment, the matching network structure includes the matching PCB portion (e.g., metal laminated dielectric, etc.) comprising a dual double sided trace representing two inductors in parallel. The matching network structure also includes the matching balun portion comprising a matching RF transformer (e.g., metal balun, etc.) representing an inductor with a large mass body and surface. In this illustrated embodiment, two inductors on the PCB 424 are representing a single inductor, and the open space is used to control the capacitances interaction with the balun 482 by limiting the amount of surface area of the PCB trace that is coupling or bonding to the balun 482. As most of the capacitive area is within the front and back traces on the PCB 424, typically the wider the opening the less the coupling capacitances, this technique is used as means to fine tweak the matching circuit.

The base assembly 450 also includes upper and lower contact pins 400 and a base ring portion or bushing 454. The contact pins 400 may comprise metal pogo pin devices and/or the spring contact assemblies 100 disclosed herein. In operation, the contact pins 400 conduct the electrical current through the PCB 424 and balun structure 482 towards the aerial whip assembly 492. The base ring portion 454 comprises an electrically-conductive threaded nut (e.g., brass or other metal, etc.) threadedly attached to the base or housing cap 458 (e.g., thermoplastic cap, etc.). The base ring portion 454 may be used as a mounting part for mounting the antenna assembly 490 to an external mount port. In operation, the base ring portion 454 conducts the ground portion of the current flow into the antenna structure. The multiband band assembly 490 may be coupled to an antenna mount (e.g., NMO antenna mount, etc.) in a similar manner as the antenna assembly 390 is mounted to the mount 396 shown in FIG. 12.

Figure 15:
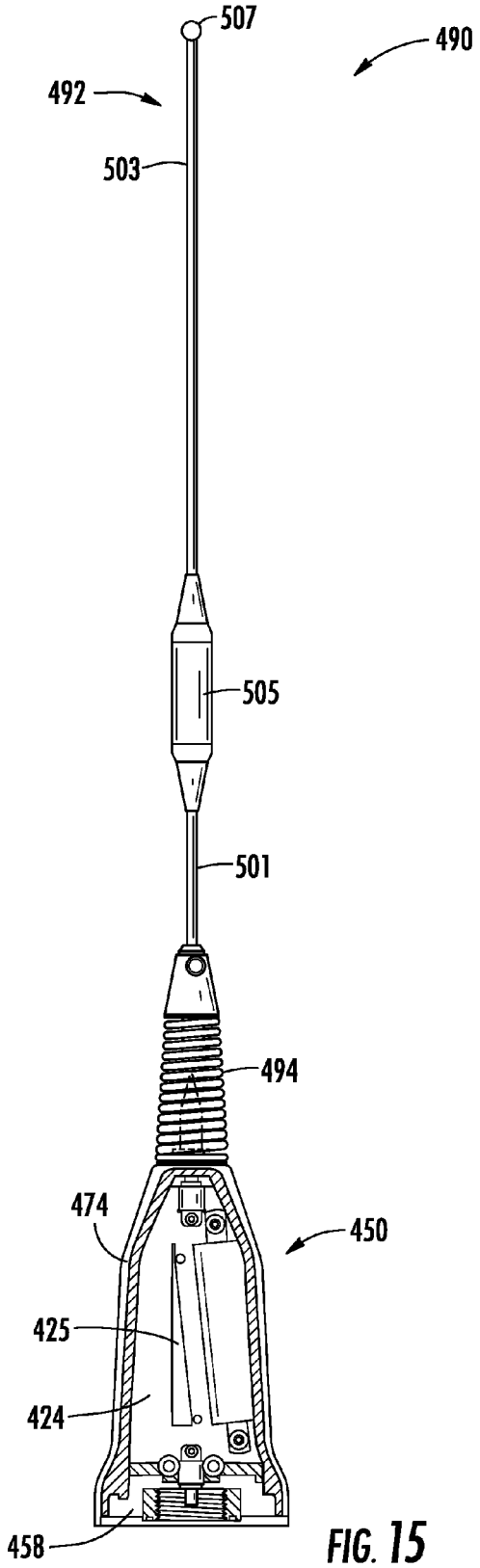
FIG. 15 illustrates the multiband antenna assembly shown in FIG. 14 with the housing shown in cross section to illustrate the antenna base assembly.
Figure 16:
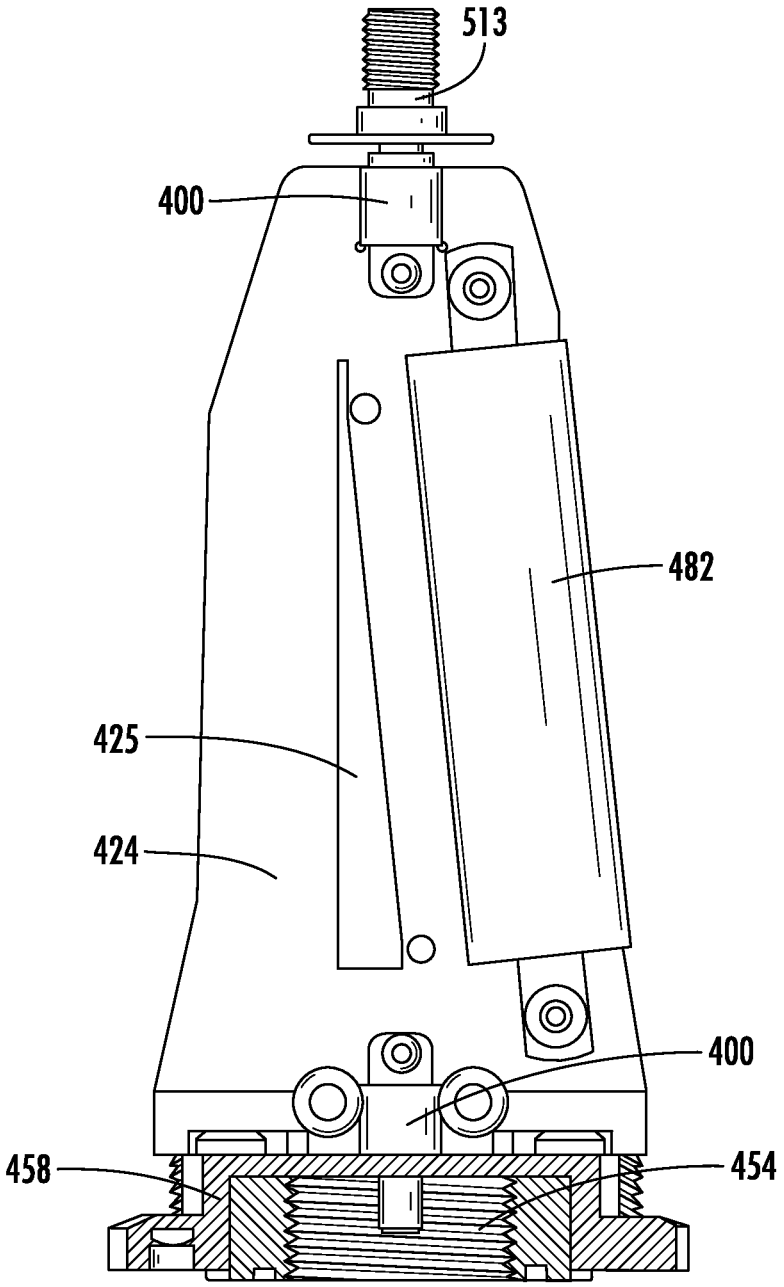
FIG. 16 illustrates the antenna base assembly shown in FIG. 15.

With continued reference to FIGS. 13 and 15, the multiband antenna assembly 490 may further include a hermetically sealed housing 474 coupled to the base 458. The aerial whip assembly 492 includes a shock absorbing spring 494 top mounted by first and second linear elements 501, 503, shown as metal (e.g., stainless steel, etc.) rods. A radio wave impedance matching helical spring (or phasing coil) (shown in FIG. 19) is disposed within a housing 505. The radio wave impedance matching helical spring (or phasing coil) electrically connects and linearly joins the first and second metal rods 501, 503 (broadly, linear elements) with a separation or spaced distance between the two rods 501, 503. An aerial radio waves defusing member 507 is coupled (e.g., via a press fit, etc.) to an upper portion of the top linearly mounted rod. For example, the top linearly mounted rod may be pressed into an opening or hole in an aerial radio waves defusing metal ball (e.g., stainless steel ball, etc.).

FIG. 17 includes a circuit diagram graphically representing the matching network provided by the base assembly 450 and graphically representing components of the aerial whip assembly 492. FIG. 18 includes a circuit diagram graphically representing the full matching network shown in FIG. 17 provided by the base assembly 450, including the concentric capacitance (C2) between first and second inductors (L1 and L2) and the capacitance (C1) from ground. The capacitance (C1) is created between the base ring portion 458 (e.g., brass ring, etc.) and the base of the lower contact pin 400. As shown by FIGS. 17 and 18, the matching network includes two primary inductors in parallel L1 and L2 in which both inductors are concentrically capacitive to each other thereby forming C2 capacitance. The first inductor L1 is provided by an electrically-conductive portion of the PCB 424, such as a metal area (e.g., copper trace, etc.) on the PCB 424. The second inductor L2 is provided by the balun 482. The capacitance C2 is provided by a dielectric or non-conductive portion 425 of the PCB 424, such as a metal-free area of the PCB 424 where the metal trace material has been etched or otherwise removed from the PCB 424. The PCB portion 425 is between the metal (first inductor L1) area on the PCB 424 and the balun 482 (second inductor L2). In FIG. 17, AI represents antenna inductance, AC represents antenna capacitance, RR represent radiation resistance, LR represents loss resistance, ZA represents antenna impedance, and ZS represents source impedance.

In this example, the bulk circuit of the matching network represents an actual ¼ wave radiator for the upper 800 MHz frequency band, meanwhile the matching network serves the purpose of impedance matching for the middle and low frequency bands. The characteristics of the concentric capacitances C2 between both inductors L1 and L2 and the capacitance C1 from ground comprises the full matching circuit as shown in FIG. 18. An advantage or benefit of using the balun 482 for inductance L2 is the increased width of the upper frequency band. This is because the larger the surface area and the mass of the balun the wider the frequency band width. The base ring portion 458 controls the shunt capacitances C1 with respect to ground and controls the resonant frequency mainly at the higher frequency range.

During operation of the antenna assembly 490, the matching network (L1, L2, C1 and C2) together with L3 (bottom rod inductance) form a ½ wave radiator for 800 MHz and 5/16 wave radiator for UHF. A ¼ wave radiator for VHF is formed by the elements beginning with the source at the base ring portion 458 up to the metal ball 507 as shown in FIG. 19. With continued reference to FIG. 17, L4 (phasing coil inductance) functions as phasing coil for the UHF and 800 MHz. The dimension of L5 (top rod inductance) represents a ½ wave element for 800 MHz and ¼ wave for UHF. With the presence of L5, the antenna assembly 490 is operable and works at 800 MHz as a stacked ½ wave antenna which corresponds to the elevation pattern.

The multiband antenna assembly 490 may also include various components and elements similar to that described above for the base assembly 250 and shown in FIG. 9. For example, and with reference to FIG. 13, the multiband antenna assembly 490 may include spring contact assemblies 400, rivets or pins, a PCB 424 with notches or cutout areas 432 and clearances or cutout areas 433, fasteners 462 and 466, sealing member 470, and sealing member 478 similar to the corresponding features of the base assembly 250.

Also shown in FIG. 13 are fasteners 509 (e.g., screws, etc.) for attaching the housing 474 to the base 458. The fasteners 509 pass through holes in the base 458 and into holes in the housing 474, which holes can be seen in the base 258 and housing 274 shown in FIG. 9. A sealing member 511 (e.g., O-ring, etc.) is shown that may be used to seal the interface between the base assembly 450 and the aerial whip assembly 492. The aerial whip assembly 492 may be mounted to the base assembly 450 via the threaded, e.g., metal, upper feed conductor 513. A label 515 may be positioned (e.g., adhesively attached to, etc.) within the bottom of the base 458, for example, to provide information (e.g., model, date, etc.) of the antenna assembly 490.

FIG. 19 provides dimensions in millimeters and inches in brackets for the multiband antenna assembly 490 for purpose of illustration only according to an exemplary embodiment. By way of further example, this exemplary embodiment of the multiband antenna assembly 490 may be used as a commercial heavy duty vehicular broadband omnidirectional mobile antenna, that is vertically polarized and 50 ohm, with a VSWR<2.5:1 at 17 feet of RG58A/U coaxial cable end, 100 Watts, less than 20 inches in height, a 2.5 inch diameter base, and operable for covering frequency bands of VHF 136-174 MHz with unity gain, UHF 380-520 MHz with a gain of 3 dBi (decibels relative to isotropic), and 760-870 MHz with a gain of 3 dBi. The multiband antenna assembly 490 may be mounted on a flat or contoured surface of a thin metallic material, such as with a standard NMO mount on the center of a vehicle with sufficient metallic ground of two feet by two feet square or more.

Figure 20:
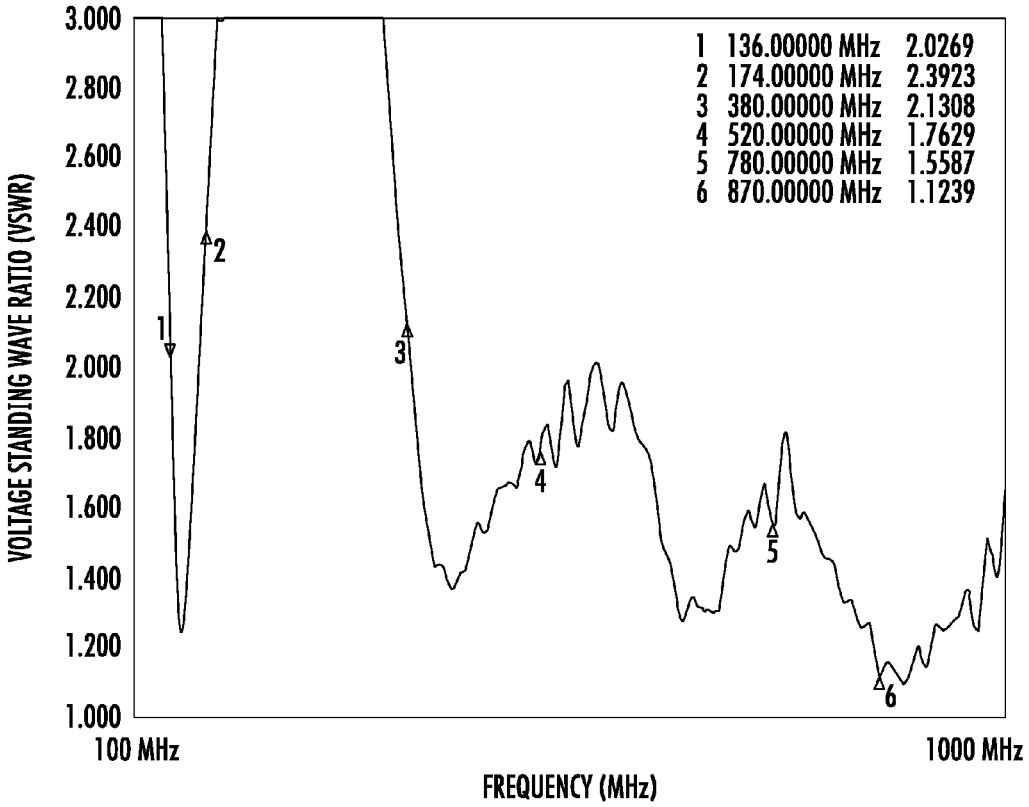
FIG. 20 is an exemplary line graph illustrating voltage standing wave ratio (VSWR) versus frequency in megahertz (MHZ) measured for a prototype of an antenna assembly having features and dimensions shown in FIG. 19.

FIGS. 20 through 22 provide analysis results measured for an antenna assembly having features and dimensions as shown in FIG. 19. These analysis results shown in FIGS. 20 through 22 are provided only for purposes of illustration and not for purposes of limitation.

More specifically, FIG. 20 is an exemplary line graph illustrating voltage standing wave ratio (VSWR) versus frequency in megahertz (MHZ) measured for the antenna assembly shown in FIG. 19. Generally, FIG. 20 shows that this antenna assembly has a relatively good VSWR of less than 2.5 for frequencies falling within the very high frequency (VHF) band from 136 MHz to 174 MHz, the ultra high frequency (UHF) band from 380 MHz to 520 MHz, and the cell/LTE 700/800 MHz band from 760 MHz to 870 MHz. These frequency bands are examples only as other exemplary embodiments of an antenna assembly may be configured to be operable and resonant at other frequencies and/or frequency bands.

FIGS. 21A, 21B, and 21C illustrate radiation azimuth field radiation patterns measured for the antenna assembly shown in FIG. 19 at frequencies of 156 MHz, 450 MHz, and 810 MHz. FIGS. 22A and 22B illustrate elevation field radiation patterns measured for the antenna assembly shown in FIG. 19 at frequencies of 450 MHz and 810 MHz. Generally, FIGS. 21A through 22B show that the antenna assembly has good omnidirectional radiation patterns at these frequencies.

The multiband antenna 490 may include one or more spring contact assemblies 100 (FIGS. 1-8) and/or a sealed base assembly 250 (FIGS. 9-11). Accordingly, an exemplary embodiment of the multiband antenna assembly 490 includes one or more elements or features of the spring contact assembly 100 and/or sealed antenna base assembly 250. In other embodiments, a multiband antenna assembly may include matching network structure of the base assembly 450 without having any spring contact assemblies or a sealed base assembly.

Accordingly, the inventors have disclosed exemplary embodiments of multiband antenna assemblies having matching networks that may provide one or more (but not necessarily any or all) of the following advantages. For example, disclosed exemplary embodiments make it possible to achieve high gain and broad bandwidth coverage in a relatively small and sleek overall package. In contrast, conventional multiband antenna matching networks restrict the achievement of both broad bandwidth and high gain due to a tradeoff of losing gain on some parts of the band coverage. Traditionally, much larger aerial structures and larger matching network assemblies have been used to attempt to obtain a fair combination of broad bandwidth and high gain.

In exemplary embodiments, the inventors have struck a balance of antenna aesthetic look and performance with a single full spectrum antenna operable across all of the most popular U.S. public safety frequencies such as the VHF frequencies from 136-174 MHz, the UHF frequencies from 380-520 MHz, and frequencies within the Cell/LTE 700/800 MHz in a package less than 20 inches in height and with a small base as a mechanical support on a standard vehicle for public safety wireless applications. In an exemplary embodiment, a unique impedance matching network is operable simultaneously with a wide band frequency spectrum including VHF 136-174 MHz, UHF 380-520 MHz, and Cell/LTE 700/800 MHz, which may supplement a single aerial structure for broadband coverage.

Exemplary embodiments may be operable on a four feet by four feet ground plane and/or with continuous power handling at 100 Watts for all frequency bands. Exemplary embodiments may provide multiple radio frequency broadband matching networks combined with no discrete components. Exemplary embodiments may include a low visible and stylish enclosed phasing coil and rod length with overall length maximum of 20 inches high. Exemplary embodiments may be omnidirectional, vertically polarized, and have simultaneous standard electrical lengths of ¼ wavelength for VHF, ⅝ wavelength for UHF, and ⅝ over ⅝ wavelength for Cell/LTE 700/800 MHz band. Exemplary embodiments may be operable with unity gain for VHF 136-174 MHz and with 3 dBi gain for UHF 380-520 MHz and Cell/LTE 700/800 MHz. Exemplary embodiments may provide multiple radio frequency broadband matching networks using open stub matching technique and in conjunction with a 0.125 inch thick Printed Circuit Board (PCB) with both approximately 3 inches in length and overall length of the antenna is approximately 20 inches tall. Exemplary embodiments may be configured to mount on a 4 feet by 4 feet ground plane and be attached with 17 feet of RG58A/U coaxial cable to achieve what a radio will see VSWR<2.5:1 on all frequency bands of VHF 136-174 MHz, UHF 380-520 MHz, and Cell/LTE 700/800 MHz.

Exemplary spring contact assemblies disclosed herein were developed by the inventors in an effort to an effective pressure electrical/mechanical connection point that deploys a minimal (or at least reduced) surface area variation, ease of manufacturing, electrical stability, and/or better (or at least satisfactory) structural strength as compared to some conventional contact assemblies. The inventors hereof recognized that some conventional contact assemblies were associated with one or more of the following drawbacks, such as an inability to handle high electrical current and power requirements, non-uniform contact area and path produced instable repeatability for electrical current flow, operator skill dependent, insufficient structural strength, production reproducibility issues eliminated the fixed tune options on higher frequency antenna models, time consuming assembly process, and/or very difficult to automate at a mass production level.

Accordingly, the inventors have disclosed exemplary embodiments of spring contact assemblies that may provide one or more (but not necessarily any) of the following advantages. For example, an exemplary embodiment of the inventors' spring contact assembly may provide good electrical contact via a rivet, may provide a strong connection to the PCB board material (e.g., FR4, etc.) without concern for cracking of non-existent solder, and/or may provide good repeatability in manufacture and a fixed tune design such that the antenna assemblies do not need to be tuned on the assembly floor during manufacture. By way of further example, an exemplary embodiment of the inventors' spring contact assembly may have a fixed shape that minimizes or reduces electrical RF current flow through the body of the conductive spring contact assembly and surface current flow variation/transformation when repeated in mass production levels. An exemplary embodiment of the inventors' spring contact assembly may provide a solderless interconnection that helps eliminate (or at least reduce) workmanship related variations. An exemplary embodiment of the inventors' spring contact assembly may have a stronger structure to minimize or reduce the possibility of disengagement from the PCB. An exemplary embodiment of the inventors' spring contact assembly may provide a two sided sandwich lock to minimize or reduce copper trace peeling effects due to vibrations. An exemplary embodiment of the inventors' spring contact assembly may be configured with a rivet fastened lock that constrains the structure to a stronger FR4 material of the board of the PCB and not to the copper trace. An exemplary embodiment of the inventors' spring contact assembly may be configured with a spring contact feature that can handle up to five hundred percent more impact and loading forces than a conventional soldered type pushpin. An exemplary embodiment of the inventors' spring contact assembly may contain a heavier section of materials allowing higher electrical current to run through, which, in turn would allow higher power handling. An exemplary embodiment of the inventors' spring contact assembly may not require any additional mechanical support from the hull body of the containing unit. An exemplary embodiment of the inventors' spring contact assembly may allow for a faster assembly and easier automation possibilities. It should be noted that the advantages disclosed herein are exemplary only and not limiting, as exemplary embodiments of the present disclosure may achieve all, some, or none of the advantages disclosed herein.

The inventors hereof have also recognized conventional antenna base assemblies provide electrical grounding but suffered many problems associated with poor seals and/or breached seals, which made the antenna prone to failure. For example, some conventional antenna base assemblies are associated with a shorter life span on shelf or in the field, a degraded performance by time caused by internal component corrosion, an open antenna hull allowing moisture condensation inside the antenna associated with temperature variation, imminent failure if mounted high or poorly, allow water migration from rain hydro pressure to seep into the antenna, imminent failure if the base gasket fails, and/or allowed only one grounding tap to feed the PCB.

Accordingly, the inventors have disclosed exemplary embodiments of sealed antenna base assemblies that may provide one or more (but not necessarily any) of the following advantages. For example, an exemplary embodiment of the inventors' sealed antenna base assembly may provide more than one grounding tap, may maintain long term performance with minimized (or at least reduced) corrosion of internal components of an antenna unit, may provide a stronger uphold against moisture and water migration into the inside the antenna unit, may minimize or reduce moisture condensation due to thermal variation, may significantly reduce the chance for failures if mounted high or poorly, may double the sealing defense to insure no failures if the base gasket fails, may significantly increase storage shelf life and infield life span, and/or enabled the antenna structure to meet higher standards such as Ingress Protection ratings. It should be noted that the advantages disclosed herein are exemplary only and not limiting, as exemplary embodiments of the present disclosure may achieve all, some, or none of the advantages disclosed herein.

Numerical dimensions and values are provided herein for illustrative purposes only. The particular dimensions and values provided are not intended to limit the scope of the present disclosure.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items. The term "about" when applied to values indicates that the calculation or the measurement allows some slight imprecision in the value (with some approach to exactness in the value; approximately or reasonably close to the value;

nearly). If, for some reason, the imprecision provided by "about" is not otherwise understood in the art with this ordinary meaning, then "about" as used herein indicates at least variations that may arise from ordinary methods of measuring or using such parameters. For example, the terms "generally", "about", and "substantially" may be used herein to mean within manufacturing tolerances.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms (e.g., different materials may be used, etc.) and that neither should be construed to limit the scope of the disclosure. In some example embodiments, well-known processes, well-known device structures, and well-known technologies are not described in detail.

The disclosure herein of particular values and particular ranges of values for given parameters (e.g., frequencies, bandwidths, etc.) are not exclusive of other values and ranges of values that may be useful in one or more of the examples disclosed herein. Moreover, it is envisioned that any two particular values for a specific parameter stated herein may define the endpoints of a range of values that may be suitable for the given parameter. The disclosure of a first value and a second value for a given parameter can be interpreted as disclosing that any value between the first and second values could also be employed for the given parameter. Similarly, it is envisioned that disclosure of two or more ranges of values for a parameter (whether such ranges are nested, overlapping or distinct) subsume all possible combination of ranges for the value that might be claimed using endpoints of the disclosed ranges.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A base assembly for a multiband antenna assembly, the base assembly comprising:

a printed circuit board;

a balun coupled to the printed circuit;

wherein:

the printed circuit board and balun are configured to be operable for providing impedance matching via a matching network that includes:

a first inductor defined by or at an electrically-conductive portion of the printed circuit board;

a second inductor defined by or at the balun, such that the first and second inductors are in parallel with each other; and a concentric capacitance defined by or at a dielectric portion of the printed circuit board between the balun and the electrically-conductive portion of the printed circuit board, the first and second inductors concentrically capacitive to each other thereby forming the concentric capacitance between the first and second inductors;

whereby the base assembly is operable for providing a multiband antenna assembly with impedance matching simultaneously with more than one frequency band.

2. The base assembly of claim 1, wherein:

the PCB comprises a dual double sided trace representing two inductors in parallel on opposite sides of the PCB; and the balun comprises a matching RF transformer representing the second inductor with a large mass body and surface.

3. The base assembly of claim 1, wherein the matching network further includes a capacitance from ground.

4. The base assembly of claim 3, further comprising:

a base ring portion configured for mounting the base assembly to an antenna mount, and operable for conducting a ground portion of electrical current flow; and a contact pin configured for providing an electrical connection between a contact of the antenna mount and the printed circuit board by which electrical current is conducted between the antenna mount and the printed circuit and balun when the base assembly is mounted to the antenna mount; and the capacitance from ground is created between the base ring portion and the contact pin.

5. The base assembly of claim 4, wherein the base ring portion is operable for controlling shunt capacitances with respect to ground and controlling resonant frequency mainly at a higher frequency range.

6. The base assembly of claim 1, wherein the base assembly is operable for providing impedance matching simultaneously with at least:

a very high frequency (VHF) band from 136 Megahertz (MHz) to 174 MHz;

an ultra high frequency (UHF) band from 380 MHz to 520 MHz; and a 700/800 MHz frequency band from 760 MHz to 870 MHz.

7. The base assembly of claim 6, wherein:

the matching network represents a one quarter wave radiator for the upper 800 MHz frequency band; and the matching network serves the purpose of impedance matching for the middle and low frequency bands.

8. A multiband antenna assembly including the base assembly of claim 1, and further comprising an aerial whip antenna assembly mounted to the base assembly, wherein the multiband antenna assembly is operable in at least a very high frequency (VHF) band from 136 Megahertz (MHz) to 174 MHz, an ultra high frequency (UHF) band from 380 MHz to 520 MHz, and a 700/800 MHz frequency band from 760 MHz to 870 MHz, with the base assembly being operable for providing impedance matching simultaneously with the VHF band, the UHF band, and the 700/800 MHz frequency band.

9. The multiband antenna assembly of claim 8, wherein the multiband antenna assembly is configured to have simultaneous electrical lengths of one quarter wavelength (λ/4) for the VHF band; five eighths wavelength (5λ/8) for the UHF band; and five sixteenths wavelength (5λ/16) for the 700/800 MHz frequency band.

10. The multiband antenna assembly of claim 8, wherein the aerial whip antenna assembly comprises:

a first linear element having an upper end portion and a lower end portion mounted to the base assembly by a shock absorbing spring;

a second linear element having an upper end portion and a lower end portion spaced apart from the upper end portion of the first linear element;

a phasing coil electrically connecting the first and second linear elements and linearly joining the upper end portion of the first linear element to the lower end portion of the second linear element, the phasing coil operable; and an aerial radio waves defusing metal ball mounted to the upper portion of the second linear element.

11. The multiband antenna assembly of claim 10, wherein:

the matching network further includes a capacitance from ground; and the matching network together with inductance of the first linear element form a one-half wave radiator for the 700/800 MHz frequency band and five sixteenths wave radiator for the UHF band;

a one-quarter wave radiator for the VHF band is formed by elements of the multiband antenna assembly beginning with a source up to the metal ball;

inductance of the phasing coil allows the phasing coil to function for the UHF band and the 700/800 MHz band; and inductance of the second linear element represents a one-half wave element for the 700/800 MHz band and one-quarter wave element for the UHF and, such that the multiband antenna assembly is operable and works at the 700/800 MHz band as a stacked one-have wave antenna which corresponds to the elevation pattern.

12. The multiband antenna assembly of claim 8, wherein:

the multiband antenna assembly has an overall height of 20 inches or less and/or a 2.5 inch diameter base or less; and/or the multiband antenna assembly is configured for use as a vehicular broadband mobile antenna; and/or the multiband antenna assembly is vertically polarized; and/or the multiband antenna assembly is omnidirectional; and/or the multiband antenna assembly has a voltage standing wave ratio less than 2.5:1; and/or the multiband antenna assembly is operable for covering the VHF band with unity gain, the UHF band with a gain of 3 decibels relative to isotropic (dBi), and the 700/800 MHz band with a gain of 3 dBi.

13. The base assembly of claim 1, wherein the base assembly is mountable to an external mobile antenna mount, which is installed to a mounting surface of a vehicle and connected to an electronic device within the vehicle.

14. The base assembly of claim 1, wherein:

the printed circuit board includes at least one hole therethrough; and the base assembly further comprises a contact assembly configured to provide a solderless connection between the printed circuit board and an antenna mount having a contact, the contact assembly including:

a first end portion having at least one hole therethrough aligned with the at least one hole of the printed circuit board, the first end portion fastened to the printed circuit board by at least one fastener disposed with the aligned holes;

a second end portion configured to electrically contact the contact of the antenna mount; and a biasing member between the first and second end portions, the biasing member operable for biasing the second end portion against the contact of the antenna mount when the base assembly is mounted to the antenna mount;

whereby the printed circuit board is connected to the antenna mount via the contact assembly without solder, such that signals are transferrable via the contact assembly between the printed circuit board and an electronic device that is connected to the contact of the antenna mount.

15. The base assembly of claim 1, further comprising:

a base coupled to the base ring portion;

a housing coupled to the base ring portion such that an interior enclosure is cooperatively defined by the housing and the base, the interior enclosure including the printed circuit board therein and being sealed to thereby inhibit the ingress of water into the interior enclosure; and one or more electrical grounding taps electrically connected to the printed circuit board, the one or more electrical grounding taps configured for establishing at least a portion of an electrically-conductive grounding pathway from outside the interior enclosure and which extends internally into the interior enclosure to the printed circuit board, whereby the one or more electrical grounding taps allow the interior enclosure to remain sealed against the ingress of water.

16. A multiband antenna assembly including the base assembly of claim 1, and further comprising an aerial whip antenna assembly mounted to the base assembly, wherein:

the multiband antenna assembly is operable in at least a very high frequency (VHF) band from 136 Megahertz (MHz) to 174 MHz, an ultra high frequency (UHF) band from 380 MHz to 520 MHz, and a 700/800 MHz frequency band from 760 MHz to 870 MHz, with the base assembly being operable for providing impedance matching simultaneously with the VHF band, the UHF band, and the 700/800 MHz frequency band; and the multiband antenna assembly is configured to have simultaneous electrical lengths of one quarter wavelength (λ/4) for the VHF band; five eighths wavelength (5λ/8) for the UHF band; and five sixteenths wavelength (5λ/16) for the 700/800 MHz frequency band.

17. A base assembly for mounting an aerial whip antenna assembly to an external antenna mount of a vehicle, the base assembly comprising:

a printed circuit board;

a balun coupled to the printed circuit;

a base ring portion configured for mounting the base assembly to an antenna mount; and a contact pin configured for providing an electrical connection between a contact of the antenna mount and the printed circuit board;

wherein the base assembly is operable for providing impedance matching via a matching network that includes:

a first inductor defined by or at an electrically-conductive portion of the printed circuit board;

a second inductor defined by or at the balun, such that the first and second inductors are in parallel with each other; and a concentric capacitance defined by or at a dielectric portion of the printed circuit board between the balun and the electrically-conductive portion of the printed circuit board, the first and second inductors concentrically capacitive to each other thereby forming the concentric capacitance between the first and second inductors; and a capacitance from ground created between the base ring portion and the contact pin.

18. The base assembly of claim 17, wherein:

the PCB comprises a dual double sided trace representing two inductors in parallel on opposite sides of the PCB;

the balun comprises a matching RF transformer representing the second inductor with a large mass body and surface; and the base ring portion is operable for controlling shunt capacitances with respect to ground and controlling resonant frequency mainly at a higher frequency range.

19. A multiband antenna assembly operable in at least a very high frequency (VHF) band from 136 Megahertz (MHz) to 174 MHz, an ultra high frequency (UHF) band from 380 MHz to 520 MHz, and a 700/800 MHz frequency band from 760 MHz to 870 MHz, the multiband antenna assembly comprising:

a base assembly operable for providing impedance matching simultaneously with the VHF band, the UHF band, and the 700/800 MHz frequency band; and an aerial whip antenna assembly mounted to the base assembly, wherein the base assembly includes:

a printed circuit board;

a balun coupled to the printed circuit;

a base ring portion configured for mounting the base assembly to an antenna mount; and a contact pin configured for providing an electrical connection between a contact of the antenna mount and the printed circuit board when the base assembly is mounted to the antenna mount;

wherein the base assembly is operable for providing impedance matching via a matching network that includes:

a capacitance from ground created between the base ring portion and the contact pin;

a concentric capacitance; and first and second inductors in parallel and concentrically capacitive to each other thereby forming the concentric capacitance between the first and second inductors.

20. A multiband antenna assembly operable in at least a very high frequency (VHF) band from 136 Megahertz (MHz) to 174 MHz, an ultra high frequency (UHF) band from 380 MHz to 520 MHz, and a 700/800 MHz frequency band from 760 MHz to 870 MHz, the multiband antenna assembly comprising:

a base assembly operable for providing impedance matching simultaneously with the VHF band, the UHF band, and the 700/800 MHz frequency band; and an aerial whip antenna assembly mounted to the base assembly, wherein the base assembly includes:

a printed circuit board;

a balun coupled to the printed circuit;

a base ring portion configured for mounting the base assembly to an antenna mount; and a contact pin configured for providing an electrical connection between a contact of the antenna mount and the printed circuit board when the base assembly is mounted to the antenna mount;

wherein:

the multiband antenna assembly is configured to have simultaneous electrical lengths of one quarter wavelength ($\lambda/4$) for the VHF band; five eighths wavelength ($5\lambda/8$) for the UHF band; and five sixteenths wavelength ($5\lambda/16$) for the 700/800 MHz frequency band; and/or the PCB comprises a dual double sided trace representing two inductors in parallel on opposite sides of the PCB; and/or the balun comprises a matching RF transformer representing the second inductor with a large mass body and surface; and/or the base ring portion is operable for controlling shunt capacitances with respect to ground and controlling resonant frequency mainly at a higher frequency range.

* * * * *

UNITED STATES PATENT AND TRADEMARK OFFICE

CERTIFICATE OF CORRECTION

PATENT NO. : 8,988,295 B2
APPLICATION NO. : 13/657538
DATED : March 24, 2015
INVENTOR(S) : Imad M. Swais et al.

It is certified that error appears in the above-identified patent and that said Letters Patent is hereby corrected as shown below:

In the Claims:

Claim 1
Column 17, line 67: add "board" after "a balun coupled to the printed circuit"

Claim 4
Column 18, line 37: add "board" after "cuit"

Claim 17
Column 20, line 56: add "board" after "a balun coupled to the printed circuit"

Claim 19
Column 21, line 35: add "board" after "a balun coupled to the printed circuit"

Claim 20
Column 22, line 21: add "board" after "a balun coupled to the printed circuit"

Signed and Sealed this
Twenty-fifth Day of August, 2015

Michelle K. Lee

Michelle K. Lee
*Director of the United States Patent and Trademark Office*